US005629259A

United States Patent [19]

Akada et al.

[11] Patent Number: 5,629,259

[45] Date of Patent: May 13, 1997

[54] IMAGE FORMATION ON OBJECTIVE BODIES

[75] Inventors: Masanori Akada; Yoshikazu Ito; Jumpei Kanto, all of Tokyo-To; Mitsuru Takeda, Yokohama; Masaki Kutsukake, Tokyo-To; Noritaka Egashira, Ichikawa; Shunsuke Mukasa, Tokyo-To; Takao Suzuki, Kawagoe; Hideo Hosoi, Tokyo-To; Yasuo Otatsume, Chiba, all of Japan

[73] Assignee: Dai Nippon Insatsu Kabushiki Kaisha, Japan

[21] Appl. No.: 395,850

[22] Filed: Feb. 28, 1995

Related U.S. Application Data

[63] Continuation of Ser. No. 34,186, Mar. 18, 1993, Pat. No. 5,451,560, which is a continuation of Ser. No. 467,415, Jan. 19, 1990, abandoned, which is a division of Ser. No. 138,384, filed as PCT/JP87/00228, Apr. 10, 1987, Pat. No. 4,923,848.

[30] Foreign Application Priority Data

| | | | |
|---|---|---|---|
| Apr. 11, 1986 | [JP] | Japan | 61-81988 |
| Apr. 11, 1986 | [JP] | Japan | 61-81989 |
| Sep. 24, 1986 | [JP] | Japan | 61-223896 |
| Sep. 24, 1986 | [JP] | Japan | 61-225473 |
| Oct. 1, 1986 | [JP] | Japan | 61-231224 |
| Jan. 14, 1987 | [JP] | Japan | 62-5066 |

[51] Int. Cl.$^6$ ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 4,505,975 | 3/1985 | Majima | 428/336 |
| 4,507,349 | 3/1985 | Fromson et al. | 428/195 |
| 4,522,881 | 6/1985 | Kobayashi et al. | 428/336 |

FOREIGN PATENT DOCUMENTS

| | | | |
|---|---|---|---|
| 60-203494 | 10/1985 | Japan | 503/227 |

*Primary Examiner*—Bruce H. Hess

*Attorney, Agent, or Firm*—Parkhurst, Wendel & Burr, L.L.P.

[57] ABSTRACT

The present invention relates to image-formation on any selected kind of objective body. The characterizing features reside in such that, based upon fed image data, required images are formed on an image-transferable sheet acting for image carry-over service and in reliance on sublimation image transfer technique, and then, by the use of said sheet with said images thus formed thereon, the formed images thereon are transferringly applied on the objective body. By adopting the above measures, the objective body can be formed sharply and clearly with any desired images, irrespective of kind and configuration thereof, with such superior results of highly improved unity and solidability between the formed images and the objective body to be decorated with.

6 Claims, 16 Drawing Sheets

IMAGE FORMATION ON OBJECTIVE BODIES

This is a continuation of application Ser. No. 08/034,186 filed Mar. 18, 1993, now U.S. Pat. No. 5,451,560, which in turn is a continuation of Ser. No. 07/467,415, filed Jan. 19, 1990, now abandoned, which in turn is a divisional of Ser. No. 07/138,384, filed as PCT/JP87/00228, Apr. 10, 1987, now U.S. Pat. No. 4,923,848, issued May 8, 1990.

TECHNICAL FIELD

This invention relates to methods and apparatus for the formation of images as prints on objective bodies through transfer of images preformed by the sublimation transfer technique, and more specifically it relates to such systems as adapted for the formation of images on any selected objective body, such as cards, clothes, papers, and transparent sheets, although these are not limitative to the present invention.

BACKGROUND ART

Reliance is made generally upon the normal printing technique for formation of images on objective bodies. For the execution of the printing technique, provision and use of printing plates (forms or blocks) are requisite. No matter how simple the image-printing is, the plate-making is a very time-consuming the laborious procedure. This is much more so in the printing of various and complexed image combinations, such as those of graphic or portrait images combined with characters, letters or barcodes, as an example, representing extremely complicated and troublesome work.

Further, in the normal printing operation, various operating conditions, including ink selection and the like, must be carefully considered, depending upon the kind and nature of the printing object, thus the best selection thereof is highly delicate and not as simple as expected.

The present invention is proposed upon careful consideration of the foregoing facts, and an object of the invention is to provide a unique process for the formation of sharp and clear images regardless of the kind and nature of the object to be printed upon, and usable and effective materials and apparatuses for carrying out this unique process.

The method of thermal image transfer (sublimation image transfer) on clothes or fabrics with the use of thermal transfer dyestuffs has been practiced for a long time. In this conventional process, a dyestuff picture layer carrying thermal transfer dyestuff is formed on a substrate sheet which is then subjected to heat in an overlapped state on a cloth or fabric, the dyestuff thereby being transferred thermally onto the latter for forming the desired images thereon. By utilizing this technique, and with recent development of the image forming technology concerning fine thermal printers and the like, various fine image forming processes have been proposed to provide fine images which are comparable to photographic images and are transferred onto plastic films from thermal transfer sheets carrying thermal transfer dyestuffs.

According to these recently proposed processes, various images of cameras, or TVs, graphic images of personal computers and the like can be reproduced easily in the form of hard copies on the surface of a transferred material such as a paper or the like sheet carrying thereon a fixedly attached layer of polyester resin, as an example. These images thus reproduced represent an amply high level comparable to those obtained by photography or fine printing arts.

The thermal transfer process so far set forth has an advantage in that it can form any image in a convenient manner yet entails a problem in that it is limited to image-transferred product preferably of polyester and the like materials which must be dyed with thermal transfer dyes. On the other hand, the image-transferred products must be limited to specifically selected shapes, preferably film, sheet or the like configuration, and thus, such materials as wood, metal, glass or ceramics cannot be formed with images in this way. Further, even if the material is plastics such as polyester or the like, and when the image-forming surface is curved or undulated, or physical body other than sheet, even if it represents a plane surface, it is almost impossible to reproduce images precisely thereon, which naturally constitutes a grave problem in the art.

With recent development and enlargement of utilizing fields of various card-style products, such as cash-cards, telephone-cards, prepayment cards; and ID-cards, there are increasing demands for providing these cards with images, symbols and codes, so as to give various other functional and/or decorative effects. Most of these cards are of planar form, but they are frequently not pliable and/or have uneven rough portions due to provision of characters and symbols, resulting in great difficulty in the scheduled image formation relying upon the thermal image transfer process.

There is therefore an urgent demand among those skilled in the art for the provision of a unique technique capable of forming sharp and clear images of desired patterns on the surface of an objective body of any preferred kind of material and having any shape and configuration and surface condition of any kind, and indeed, for combining and unifying image- and decoration effects.

DISCLOSURE OF THE INVENTION

The present invention is basically based on such a principle that a first image transfer pattern is formed on an image transfer material, preferably an image transfer sheet, and in the form of dyestuff images through the sublimation image transfer process executed by first image transfer means, depending upon given image data, preferably including those of letters, characters, symbols, line images, graduated graphic representations, and then the first transfer pattern is transferred to second transfer means for retransferring the images onto an objective body so as to provide a final product.

Based upon the image data fed from various image data input means and at the first image-transfer means, a thermal head is actuated to execute printing operation through a dyestuff film (thermal image-transfer sheet) on an image-transfer material (or more specifically on an image-transferable material which means an image-transferable sheet. This image-printing is carried out according to the sublimation or sublimative image transfer technique. Thus, in this case, the dyestuff on the dyestuff film is transferred or shifted under the influence of heat energy from the thermal head onto the image-transfer material through sublimation, thus providing the first image-transferred means. Since this first image-transferred means has been thus formed with the images by the sublimated dyestuff, they are, then, transferred onto the second image-transferable means which will be brought into tight contact with the object to be decorated and subjected to heat and pressure for execution of further image-transfer operation to provide the final desired product.

In the present invention, the image-transfer material (image-transferable sheet) is, as above referred to, formed with images by the sublimative image tansfer technique for providing first image-transfer means which has highly sharp and clear images as the operation and results of the characterizing feature of the sublimation image-transfer technique. Therefore, because of the transfer of such sharp and clear images onto the object, it becomes possible to form the images thereon, and indeed, practically irrespective of the kind and nature of the object. In this way, thus, fine image-formation is assured onto practically any objective substance.

And further, by execution of control of the thermal energy applied during the sublimative image-transfer step, the resulting color effect is superior and the image quality is good.

The images sublimatingly applied and formed in the foregoing way are subjected to a further transfer, and onto a substrate product, for providing a final decorative product as desired. In this final product, it should be noted that the underlying layer underneath the images during the sublimative image-transfer stage appears now at the top, acting thus as a kind of protecting layer upon up-and-down positional conversion during execution of the second and final image-transfer stage, resulting in realization of various and numerous effects. As an example, attainment of substantial reduction of contamination, improvement of light resistance, weather resistance and chemical resistance; substantial reduction of color fading; provision of glazing effect; easier and simpler introduction of granular and/or undulated image appearance.

The inventive process is carried into effect basically in such a manner that an image-reception layer provided on one surface of an image-transferable sheet is subjected to an image-forming step with the use of dyestuff capable of depositing therein depending upon the fed image data, so as to form the required images, and then, the image-reception layer of the image-transferable sheet, having been image-fixed and thus now image-carrying, is stuck onto the surface of the object to be decorated upon.

As for the image-transferable sheet adapted for use in the image-transfer during execution of the inventive process, it consists basically of a sheet-like substrate and a reception layer attached, however, in a separable manner, onto one surface thereof. As a modification of the inventive process from the basic mode set forth above, the sheet-like substrate is caused to remain, even after completion of the image-transfer step, as may be occasionally required. In this modified case, it is unnecessary to make the image-reception layer of the image-transfer sheet separable.

Under occasion, the inventive process may be brought into effect in such a way that the image-reception layer of the image-transfer sheet is transferred upon execution of the image-forming step, and indeed, once onto an intermediate image-transfer substrate which is then retransferred, together with the once transferred image-reception layer, onto the surface of an object to be decorated on, and thus, in a retransferring manner.

BEST MODES FOR CARRYING OUT THE INVENTION

Figure 1A:
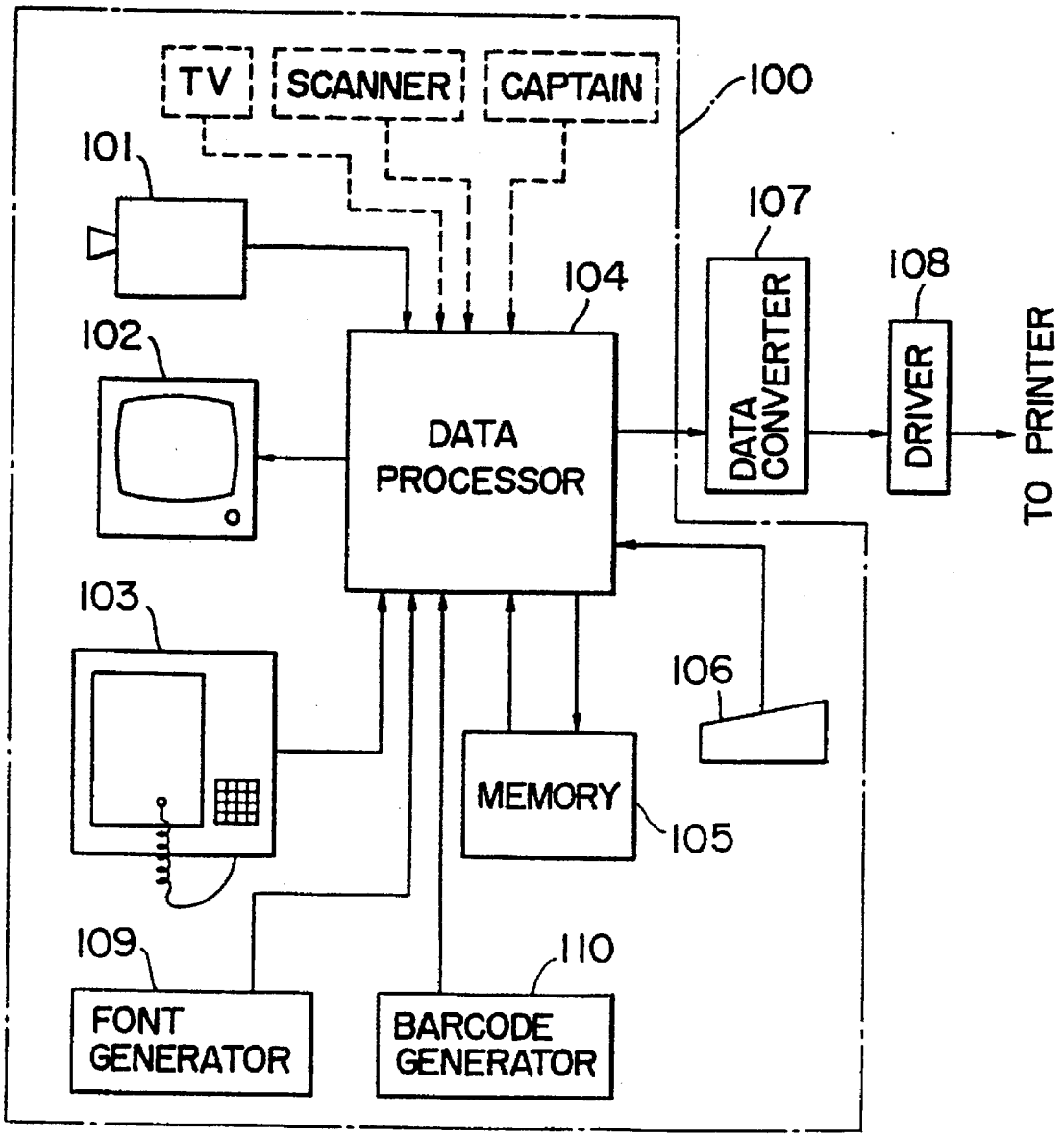
FIG. 1A is a block diagram, showing a preferred embodiment of the apparatus according to the present invention.
Figure 1B:
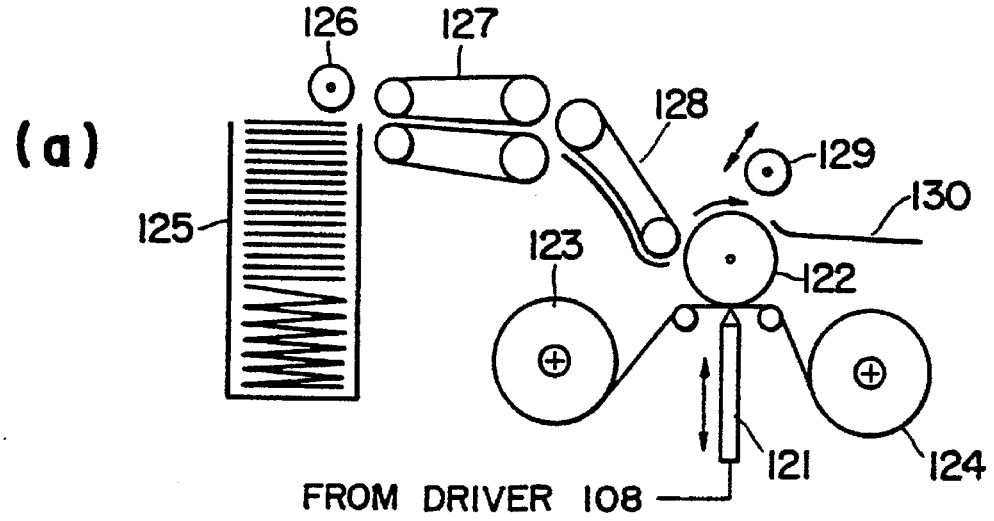
FIG. 1B is a schematic view illustrating at (*a*), (*b*) and (*c*), several image-transfer steps for the execution of a process according to the invention.
Figure 1B:
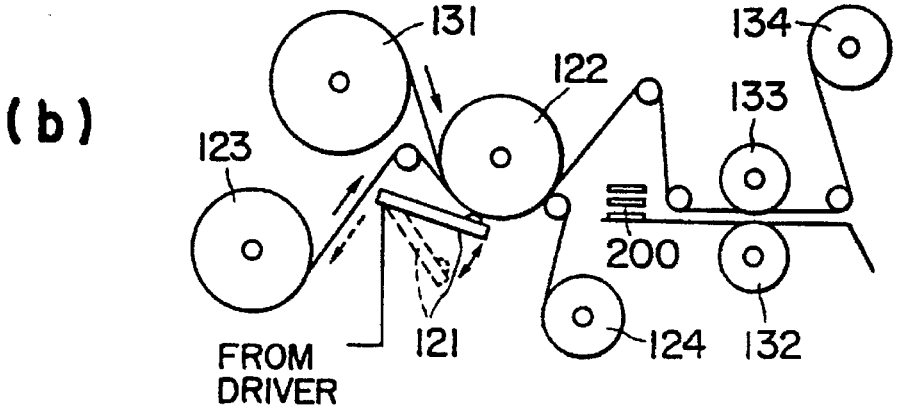
Figure 1B:
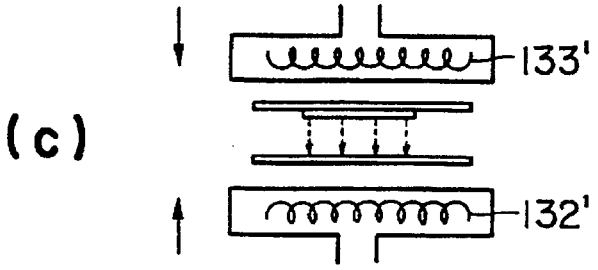

Referring now to FIG. 1A and FIG. 1B, (*a*), (*b*) and (*c*), a basic schema of the inventive image data processing and image formation .will be illustrated. First, in FIG. 1A, numeral 101 represents an image input means which is adapted for forming image data based upon optical and the like inputs delivered from a TV-camera, line sensor or the like. Other than those above enlisted only by way of example, video; CD; TV; scanner; personal computer, captain system, capable of providing R.G.B.- and picture image and the like signals may also be utilized in a similar way. The image signal data delivered from the image input means are fed through a data processor 104 to a memory 105 for being stored therein. These stored data can be taken out from the memory and fed through data processor 104 to display means 102 for being displayed thereat.

To the data processer 104, a mouth/tablet digitizer and/or the like position data processer 103 is electrically connected for introducing position data concerning displayed images appearing at the display 102. In addition, key board and the like character data input means 106 and font generator 109 are provided for introducing character data. Still further, a barcode generator 110 is provided for introducing barcode when necessary. By the use of these means and units, various additional processing modes can be executed.

The thus processed data are subjected to conversion at a data converter 107 into proper data adapted for operating a sublimation transfer printer and fed forward through a driver 108 to the thermal head.

In this case, by controlling the current duration period to the thermal element of the thermal head, the transfer quantity from the dyestuff film (thermal transfer sheet) is controlled depending upon the thermal energy of the element for realization of the desired gradation degree of concentration on the transfer sheet. There are two different modes of such control of current duration period as follows:

(a) A method for controlling the pulse length corresponding to the picture element in the impressed data to the thermal element of the thermal head or, more specifically, a series data introduced as input to the shift register shown in FIG. 6 and to be described more specifically hereinafter.

(b) A method for controlling the number of pulses of the pulse series corresponding to the picture elements of the data impressed upon the thermal element in the thermal head (in this case, the pulse length being constant).

The degree of gradation of the transfer image can be controlled in the above mentioned way by the regulation of the current-conducting period depending upon the desired gradation degree. On the other hand, the image concentration can be controlled by adjusting the pulse length or the number of pulses contained in the pulse series in correspondence to the picture elements contained in the data as introduced in the shift register and depending upon the driving mode of the thermal head. Further in this case, if the number of gradation of introduced image data is larger than that which can be expressed by the printer unit, a proper conversion operation can be performed by the known strobe control method. As an example, in such case, the conversion of gradation number 256 to 64 may be executed by a ROM, and the thus reduced gradation number can be used as output.

Next, referring to FIG. 1B at (*a*) and (*b*), reference numeral 121 represents a thermal head which receives signals from the driver 108 shown in FIG. 1A. This thermal head 121 is arranged in opposition to platen roll 122, forming the printing position therebetween. The dyestuff film (thermal transfer sheet) is fed from a delivery roll 123 to a winding roll 124 through this printing position, these structural and functional features being commonly employed in both the arrangements shown in FIG. 1B at (*a*) and (*b*).

In the case of FIG. 1B, (*a*), the mechanism is so arranged that card or sheet style transfer sheets are printed with dyestuff images.

On the other hand, in the case of FIG. 1B, (b), the mechanism is so arranged that cards are continuously produced with the use of a film style transfer sheet and a dyestuff film in combination.

Now turning back to FIG. 1B, (a), a number of transfer sheets (cards, sheets or the like) have been stacked and stored within a storage casing 125 and are being thrust upward from below by a spring so that the uppermost sheet is kept in pressure contact with a take-out roll 126. With the rotation of the roll 126, the sheets are successively delivered from the casing 125 by conveyer belts 127, 128 onto a platen roll 122. Each one of the sheets is fixed on the peripheral surface of the platen roll, now positionally indexed, by means of a gripper or the like mechanical attaching and separating means, static attracting means, or electromagnetic attaching means. Then, the roll 122 is so rotated that the transfer sheet is positioned at the ready-for-printing-position.

Next, the thermal head 121 is brought into pressure contact with the transfer sheet through the intermediary of the dyestuff film, and then the thermal head 121 is energized with electric current while the dyestuff film and platen roll 122 are moved in synchronism for the execution of image transfer (first image transfer).

Upon execution of the image transfer, the platen roll 122 is rotated, the gripper is released and the take-out roll 129 is rotated and brought into pressure contact for taking out the image transfer sheet onto a tray 130.

The thus taken-out sheet is brought into overlapped state with a new image transfer sheet, not shown, and then, both the sheets are fusingly united together by pressure application of a heated roll, not shown, for execution of a second transfer step job. The whole operation has thus been completed. Before the fusion process, the sheets may be subjected to punching, trimming and/or the like processing, if necessary.

By execution of the foregoing operational steps, a monocolor printing operation has been completed. However, in the case of multicolor printing, use is made of tricolored or quadruple colored dyestuff film and the corresponding printing operations must be repeated. In this case, upon completion of a single monocolor printing procedure, the platen roll is rotated without contact of the take-out roll 129, until it arrives again at the printing-initiation position, and so on.

In the following, a tricolor printing job will be illustrated with reference to FIG. 1B, (*b*), and with use of three different series color zones, of cyan, magenta and yellow.

First, a platen roll 122 is positionally indexed, and an image transfer sheet taken out from the roll 131 and a dyestuff film taken out from the roll 123 are brought into pressure contact in an overlapped state. Then a thermal head 121 is pressed against the platen roll 122 through the intermediary of the overlapped sheets. At this stage, the platen roll 122 is rotated counterclockwise while synchronism is kept between the platen roll 122 and the dyestuff film, and the thermal head 121 is kept electrically energized. In this way, the first color printing is executed.

Further, the dyestuff film is fed to the second color zone position, and then, the platen roll 122, the dyestuff film and the image transfer sheet are fed forward clockwise around the center roll 122. Thus a second color printing step is executed.

Further, the print-serviced two color sections of the film is fed back counter clockwise around the center of the platen roll 122 for the execution of a third color printing step. Then, each card sheet is taken out from the stack 200 under the action of take-out rolls or the like, not shown, towards and between a pair of thermal transfer rolls 132, 133, brought into overlapping state with the image transfer sheet positionally indexed and already subjected to image transfer steps as was described above, and finally subjected to a picture printing operation by pressurizing application of the thermal image transfer rolls 132, 133 from both sides of each taken-out card, and so on.

The color-printing step with the use of the thermal head is carried into effect in the following manner, as an example.

(First color printing)

Platen roll, image transfer sheet and dyestuff film perform the printing while they are moved in the counterclockwise direction.

(Second color printing)

Platen roll and image transfer sheet are moved in the clockwise direction while the dyestuff film is moved at the same speed and in the counterclockwise direction for performing the color printing under consideration.

(Third color printing)

Platen roll, image transfer sheet and dyestuff film are moved in the counterclockwise direction for execution of the color printing under consideration.

In the modified arrangement shown in FIG. 1B, (*c*), thermal image transfer rolls 132, 133 have been replaced by a flat press type image transfer head having up-and-down movable flat printer elements 132', 133'.

It should be noted that in the course of the foregoing first and second image transfer steps, image reversal phenomenon is necessarily brought about upon execution of each image transfer step. In other words and more specifically, when two successive image transfer steps in the foregoing sense are executed, reverse images which have once appeared will return to the original normal images. Therefore, when the printed-out products are to be provided upon execution of the first image transfer step, it is necessary to provide reversed image data in the signal processing system. For this purpose, it is only necessary to reverse the addressing order at the data introduction or readout stage into or from the memory.

Figure 1C:
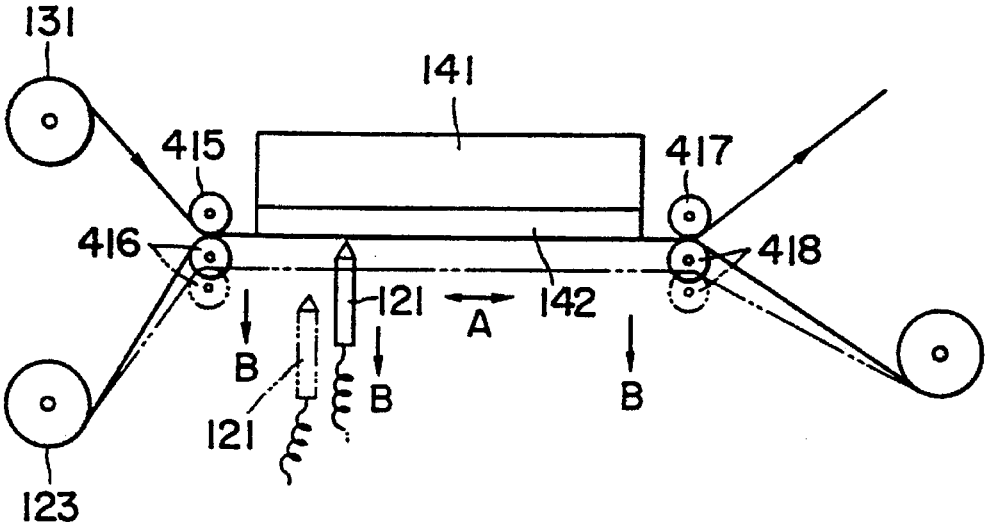
FIG. 1C is a schematic view of an image-transfer step, using a platen roll.

In the modified arrangement shown in FIG. 1C, the foregoing platen roll means has been replaced by a metal block 141 lined with a rubber plate 142 in an overlapped manner. The image transfer sheet and dyestuff film are fed out from respective rolls 131 and 123. With the use of this modified arrangement, the dyestuff surface layer of the dyestuff film can be brought into tight contact with the image-receiving surface layer of the image transfer sheet, and thermal energy will be transferred evenly form the thermal head 121 to the dyestuff film.

In this case, the image transfer sheet is delivered from the roll 131, and the desired zone or region of the sheet is set underneath the rubber plate 142 (step 1).

Figure 1D:
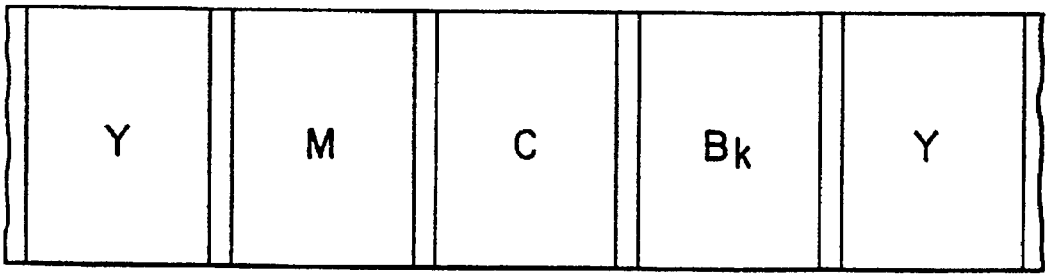
FIG. 1D is a plan view of part of a multi-color dyestuff film adapted for use in an image-forming step.

At the same time, the dyestuff film shown in FIG. 1D on an enlarged scale is delivered from the roll 123 and a selected one of the different color regions is set underneath the rubber plate 142 (step 2).

Next, the thermal head 121 is brought into the rear surface of the dyestuff film which is the opposite surface to the dyestuff-coated front layer, and the head 121 is driven while it is being translated in the direction shown by an arrow A, images thereby being formed at the specifically allocated zone(s) or region(s) of the image transfer sheet (step 3).

Further, the thermal head 121 and rolls 416 and 418 are shifted downwards as shown by arrows B, so as to form an idle gap between the image transfer sheet and the dyestuff film for allowing the latter to shift towards the next following color region (step 4).

Further, the thermal head 121 and rolls 416 and 418 are returned to their original positions, whereupon the third and further succeeding steps are repeatedly executed until a certain predesired number of color printings are completed.

As shown in FIG. 1D, the dyestuff film is colored to have several different color regions denoted by Y (yellow), M (magenta), C (cyan) and Bk (black). However, the arrangement order is not limited to that shown: Y; M; C and Bk. In addition, as occasionally required, the Bk-region may be dispensed with. Further, as the color elements to be adopted in the Y, M, C-system may not be limited to the three primary colors provided by the subtractive color mixture. On occasion, a characterizing color which means such a color as preadjusted to provide an objective specifically selected one may be used to form the images concerned. As a further modification, the arrangement shown in FIG. 1C may be so modified that the traveling direction of the image transfer sheet is selected to be perpendicular to that of the dyestuff film.

Figure 1E:
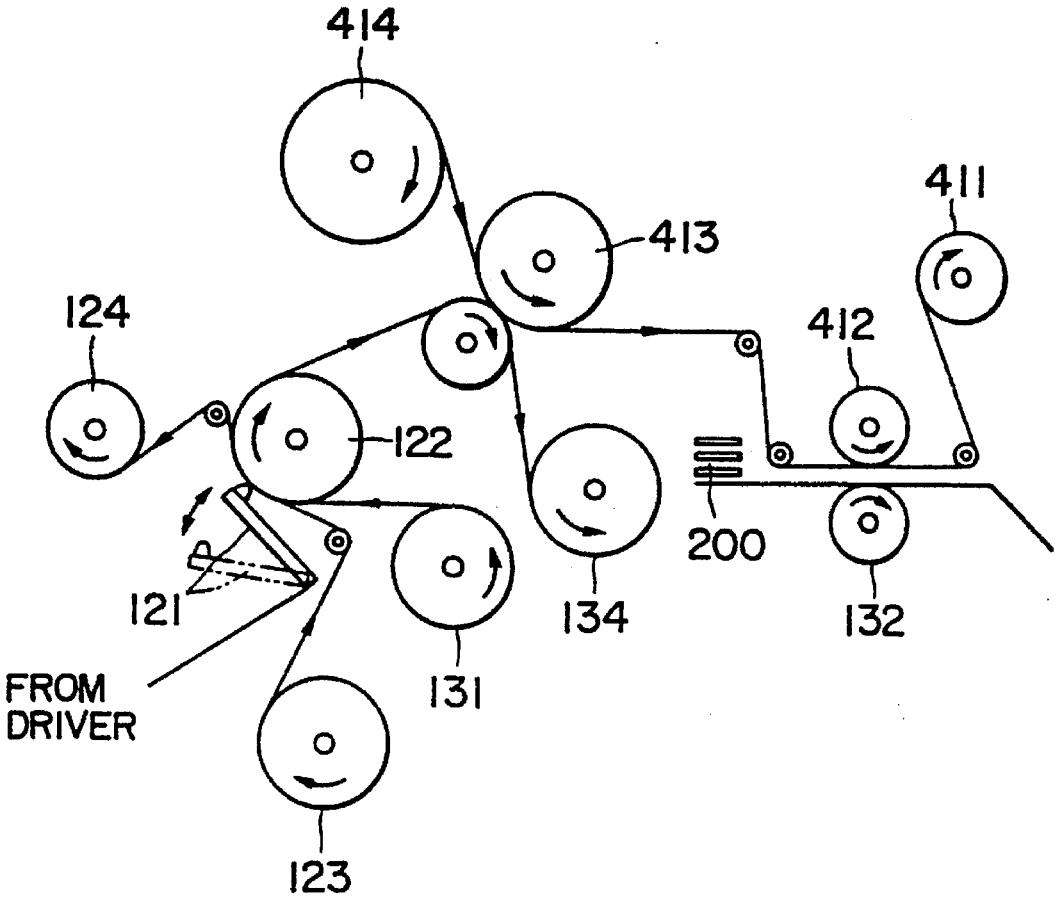
FIG. 1E is a schematic view for the illustration of several image-transfer steps.
Figure 2:
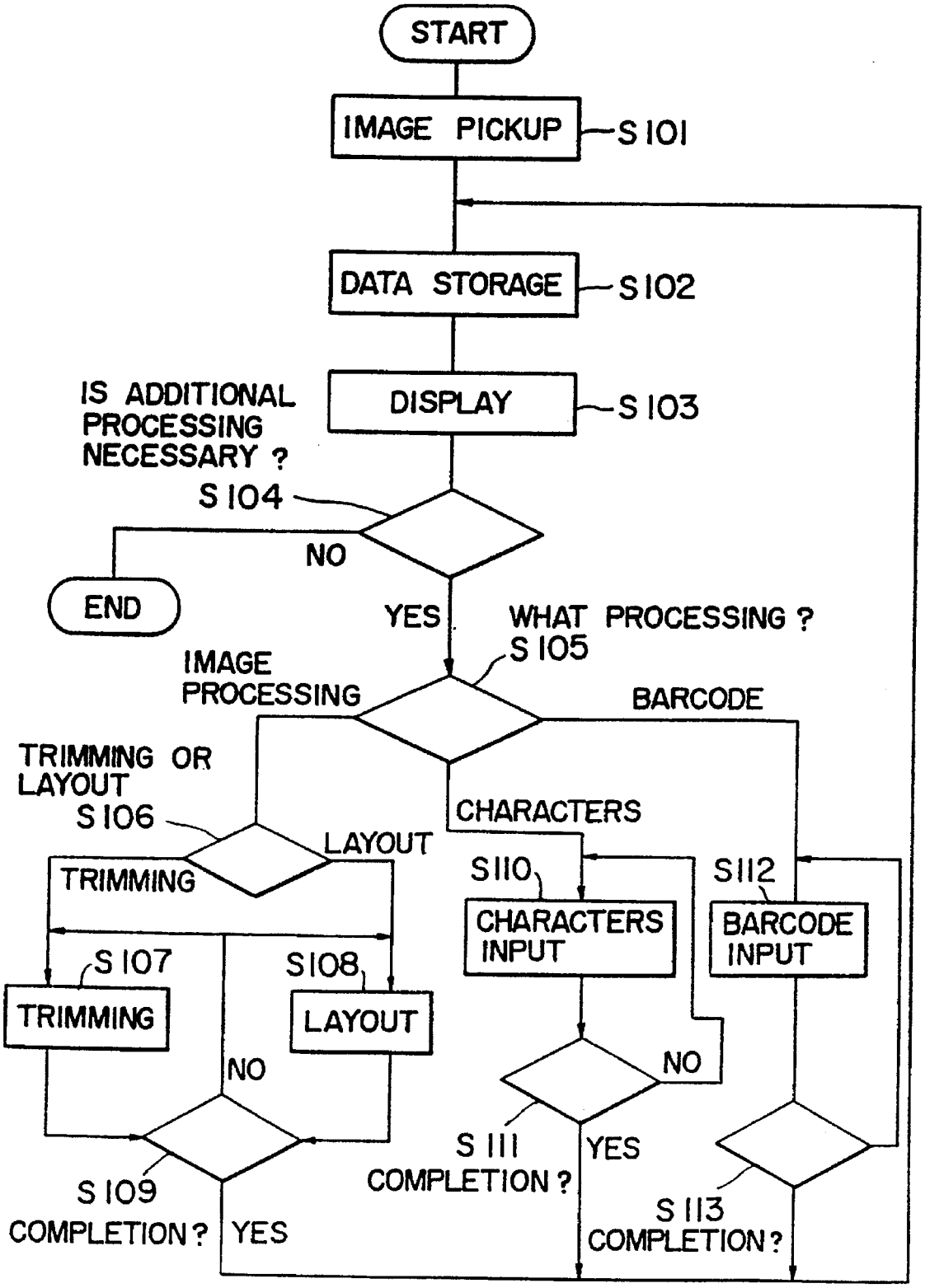
FIG. 2 is a flow chart of successive operation steps with use of a data-processor, shown in FIG. 1, functioning as an operating center.

FIG. 2 is an operation flow chart for showing schematically operational modes taking the data processor 104 adopted in the embodiment shown in FIG. 1 as the centrum of description. The operational contents of several working parts downstream of the data converter 107 will be set forth separately hereinbelow. Now referring to FIG. 2, in combination with FIG. 1 and at the step of S101, image pickup operation is carried out by means of the image pickup means 101. For execution of this step, it may be better to pick up the face of a person per se which is to be represented on the card, or alternatively, a photograph, portrait or imagery product thereof will do. Depending upon the nature of the object, a TV camera, line sensor or the like instrument may naturally be selectively utilized.

The data taken by the image pickup means 101 are stored through the data processor 104 at a memory 105 (S102). By the use of these stored data, image or images is/are displayed at the display 102 (S103). Since this display image is not yet subjected to any processing, it is generally unsuitable for representing on the card. However, under certain circumstances, it may be represented thereon as it is.

Then, the operator observed the displayed image or images on the display unit 102 and adjudges whether additional processing is necessary or not (S104). If it is not necessary, he will manipulate the key board 106 to make a certain operation, resulting in the termination of processing at the data processing unit 104, data being fed out therefrom to the succeeding data converter 107.

On the contrary, when additional processing is necessary, the operator observes carefully the displayed image or images on the unit 102 and adjudges whether the picture image data, or character data or barcode data should be processed. If the picture image data should be processed, such an operation is made for selecting the proper mass of trimming or layout within the menu range of position-data input means 103. By the execution of this operation, functions and operations at steps S105 and S106 can be executed at one stroke. If trimming is taken as an example, the next step is executed in such a way that position data are fed from the position input means 103 to the data-processer 104 with the use of a carsor. When a tablet digitizer is used as the position data input means, the carsor image displayed in an overlapped manner on the displayed picture image appearing at the display unit 102 by carsor manipulation is positionally specified beforehand in registration with the specified position on the card, for determining the trimming range. Then the operation is carried out in such a way that the picture image data outside the specified trimming range are canceled. By completing these operations, data processing operations relating to step 107 are executed, and, then, the mass for completion of the menu range is selected out. By these measures, steps progress through S109 to S102, and data storing is executed, and further, display representation is brought about through step S103. If there is no need for additional processing, an operation termination manipulation is carried out as before at key board 106, and further operations will be made through data converter 107.

As for the layout, the operation is carried out with the position data input means 103, similarly as in the foregoing trimming operation. More specifically, layout is selected out in the menu range of position data input means 103, and the overall configuration of the card and the display position of picture image are shown at display unit 102. Then, image inclination correcting operation and the like are carried out so as to realize correspondence thereof with the displayed positional information, the processing operations relating to step S108 thereby being brought about. After completion of these operations, the mass for the ending in the menu range is selected.

In this way, when selection is made from the menu range by reliance on the position data input means 103, trimming or layout operation can be brought about. At this stage, when manual operation is carried out at the key board 106, introduction of character data is executed (S110). As the character data in this sense, in the case of ID card, as an example, the name and/or birthday, month and year of the owner may be used. The data introduced from the key board 106 in accordance with the output character style from the font generator 109 are shown at the display unit 102 in the specified positions on the displaying surface and respectively arranged in accordance with display items. The operator acknowledges these items and detailed displays of the represented images. When he acknowledges them as being true, he will operate the key board 106 for showing the operation ending (S111).

Upon ending the operations as described above, the data are stored in memory 105 (S102) and represented at the display 102. The operator will acknowledge again this fact, and upon the execution of this, the operations are terminated.

As for the barcode introduction, the data are subjected to inputing at steps S112 and S113, as in a manner similar to the character data introduction as set forth above. The barcodes and the like data may be introduced separately through printing or other mechanical method.

Figure 3A:
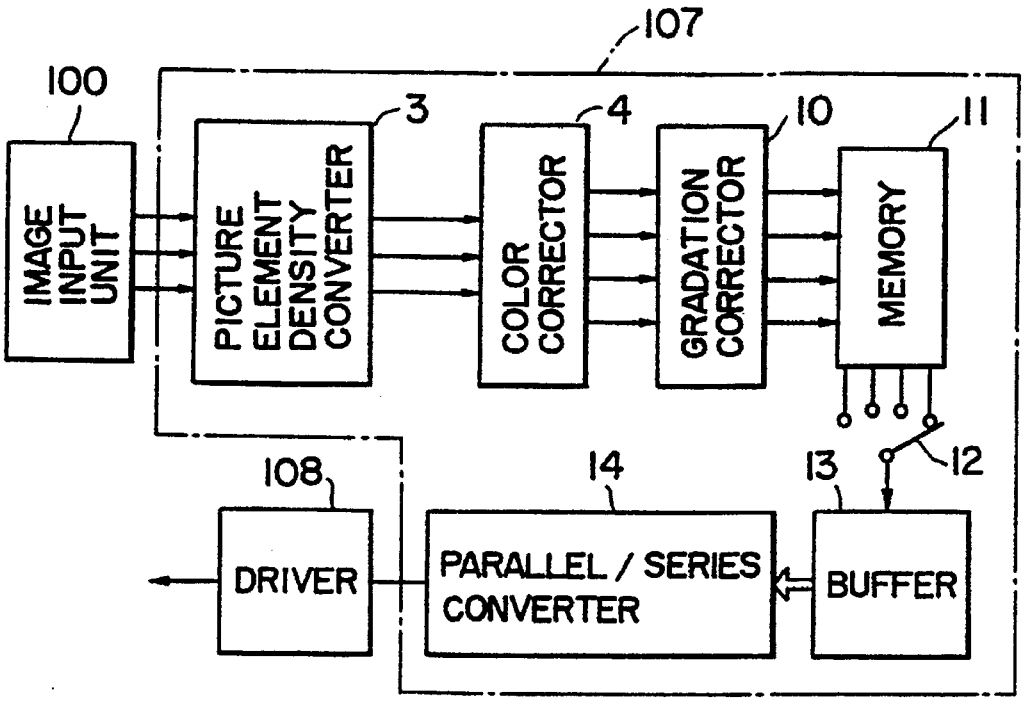
FIG. 3A is a schematic block diagram, showing a data-processor for the printer.

In FIG. 3A, a data processing circuitry usable in the sublimation image transfer printing method is shown only schematically. As shown, the circuitry 107 comprises a picture element density converter 3; a color corrector 4; a gradation corrector 10; a memory 11; a switch 12; a buffer 13 and parallel/series converter 14. The picture element density converter 3 is connected to a picture image input unit 100.

The unit 100 serves for generation of three primary color data of R.G.B.- or Y.M.C.-mode from original picture images and is connected through the picture element density converter 3 to the color corrector 4. The converter 3 converts the picture element density of the image data fed from the unit 100 to the desired one, by subtracting or supplementing, as the case may be, image data for each color element. It should be mentioned that for attaining high quality hard copies, conversion of the picture element density to at least 10 lines/mm or so is preferable.

Color corrector 4 consists preferably of a color decoder, level adjuster or color converter, and serves to correct three primary color data converted to those of a predetermined density of picture elements in consideration of characteristics of the image transfer ink in the image transfer sheet and in addition to provide black color data.

The data processing circuitry 107 is connected through a driver 108 to the sublimation image transfer printer.

Figure 4:
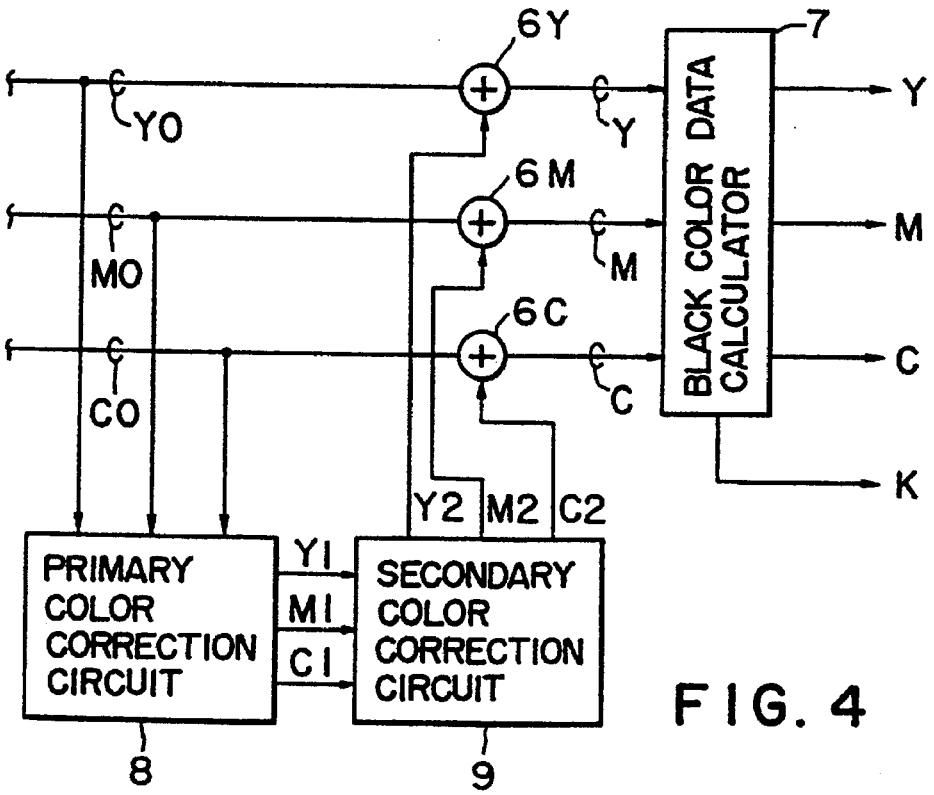
FIG. 4 is a schematic block diagram, showing a color correction unit shown in FIG. 3A, and several related parts cooperating therewith.

In FIG. 4, an example of the color corrector 4 is shown schematically in structure. As shown, it comprises adders 6Y; 6M and 6C, a black color data calculator 7, and primary and secondary color correction circuits 8 and 9. Primary color correction circuit 8 serves for making correction of turbidity of the image transfer ink, while secondary color correction circuit 9 provides a capability of arbitrary and selective correction control relative to specifically selected color hue.

The gradation corrector 10 is so arranged as to make correction of the gradation of the data for each color Y, M, C or K (representing black color) fed from the foregoing color corrector 4 when necessary. For this purpose, the corrector 10 includes a gradation circuit (not shown) and the like, whereby a certain mode of highlight stressing or shadow stressing is introduced and realized.

The memory 11 functions to preserve temporarily the data of each color delivered from the gradation corrector 10, a selection switch 12 being provided at the output side of the memory for selective writing-in of the data of each color to the buffer 13. The buffer 13 is capable of writing-in the data of one line of the image transfer head 16 and kept in connection with the parallel/series converter 14 adapted for converting parallel data into series data. Additionally, in the simplified machine, black color data series is dispensed with in some instances.

Figure 5:
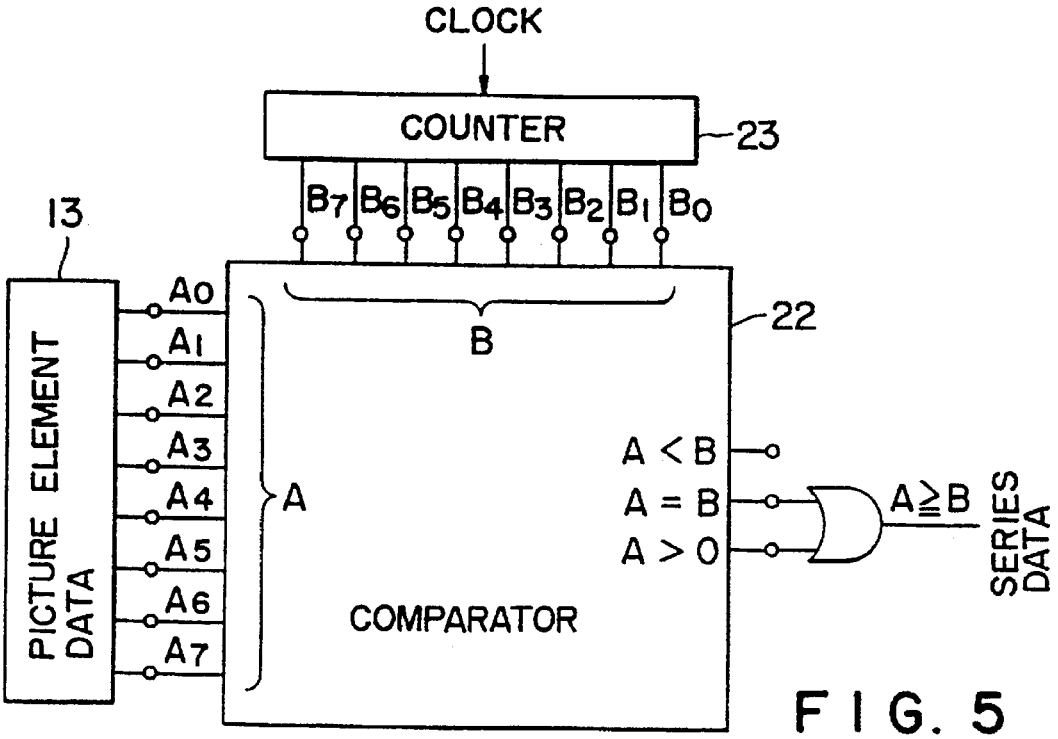
FIG. 5 is a schematic block diagram of a comparator and several related parts cooperating therewith.

In FIG. 5, a schematic construction of the parallel/series converter 14 is shown. As shown, parallel data delivered from the buffer 13 are fed to an input side of a comparator 22, while outputs from a counter 23 are fed to another input side of the comparator 22 which delivers the converted series data to the driver 15 for driving a thermal head 121.

If necessary, however, the comparator 22 may be replaced by a converter table, not shown, utilizing a parallel/series converting ROM.

Figure 6:
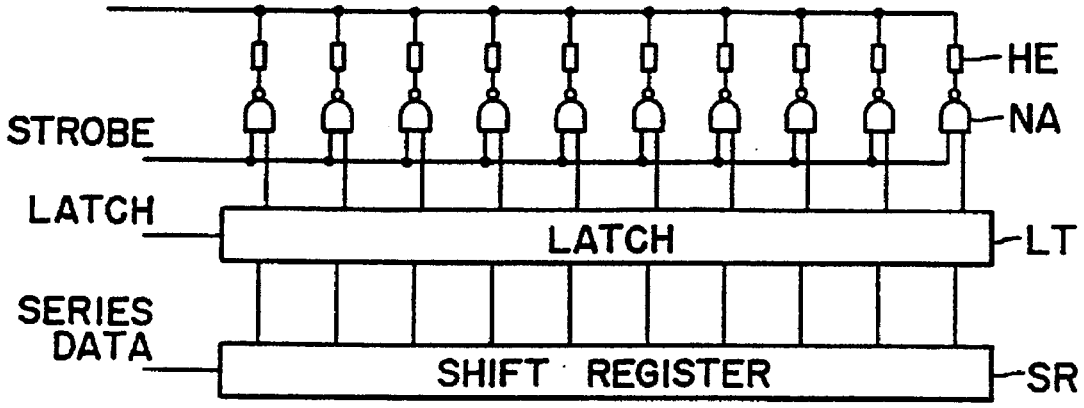
FIG. 6 is a circuit block diagram of an image-transfer head shown in FIG. 1B.

In FIG. 6, a detailed circuit schema of the thermal head 121 is shown. As shown, series data delivered from the comparator 22 are fed into a shift register SR and thence, after being subjected to latching at a latch circuit LT, fed to thermal elements HE through NAND gates NA which are fed at respective one side inlets with strobe signals.

Next, referring to FIG. 3A, the operation of the data processing circuitry 107 will be described more specifically.

First, when three primary color image data are fed from the picture image inlet circuit 100 to the picture element density converter 3, the latter converts these three primary color data to those which represent a predetermined picture element density and then are fed to the color correction unit 4. In this case, it is assumed that the unit 4 is fed with three primary color data expressed in respective concentration signals, which are of yellow: Y0; of magenta: M0 and of cyan: C0, respectively, in the present example.

These data: Y0; M0 and C0 are, as shown in FIG. 4, fed through respective adders 6Y; 6M and 6C to the black color data calculator 7, to provide a K-output as expressed mathematically by the following formula:

$$K=\min(Y, M, C)$$

wherein, "min" represents a function which provides a possible minimum value.

These data: Y0, M0 and C0 are fed from the converter 3 to the primary color correction circuit 8 to provide primarily corrected data Y1, M1 and C1 which are thence fed to the secondary color correction circuit 9 to provide, through calculation, secondarily corrected data: Y2, M2 and C2, respectively. These are then fed to respective adders 6Y, 6M and 6C, which add them to respective data Y0, M0 and C0, to provide respectively added output data Y, M, and C to be fed to the gradation correcter circuit 10, respectively, after being utilized for calculation of the K-output signal value.

The primary color correction circuit 8 serves to calculate primarily corrected data: Y1, M1 and C1 which are necessarily utilized for correct-out of transfer ink turbit. In this case, the original data: Y0, M0 and C0 are subjected to matrix calculation to provide the primarily corrected data Y1, M1 and C1, as folows:

$$Y1=k_{11}\cdot C0-k_{12}\cdot M0+k_{13}\cdot Y0$$

$$M1=k_{21}\cdot C0+k_{22}\cdot M0-k_{23}\cdot Y0$$

$$C1=k_{31}\cdot C0+k_{32}\cdot M0-k_{33}\cdot Y0$$

where, $k_{ij}$ represents weight coefficients:

$i$=1–3; and $j$=1–3.

The secondary color correction circuit 9 serves to calculate secondary color correction data Y2, M2 and C2 from primary color correction data Y1, M1 and C1 by modifying the latter to make certain thereto by performing matrix calculations so as to provide a capability for making an arbitral and selective color control at a certain specifically selected-out color hue, in the following manner:

$$Y2=Y1+l_{11}\cdot\Delta B+l_{12}\cdot\Delta C+l_{13}\cdot\Delta G+l_{14}\cdot\Delta Y+l_{15}\cdot\Delta R+l_{10}\cdot\Delta M$$

$$M2=M1+l_{21}\cdot\Delta B+l_{22}\cdot\Delta C+l_{23}\cdot\Delta G+l_{24}\cdot\Delta Y+l_{25}\cdot\Delta R+l_{26}\cdot\Delta M, \text{ and}$$

$$C2=C1+l_{31}\cdot\Delta B+l_{32}\cdot\Delta C+l_{33}\cdot\Delta G+l_{34}\cdot\Delta Y+l_{35}\cdot\Delta R+l_{36}\cdot\Delta M$$

wherein, $l_{ij}$ represents weight coefficients:

$i$=1–3;

j=1–6;

$\Delta B$, $\Delta C$, $\Delta G$, $\Delta Y$, $\Delta R$, $\Delta M$: characterizing color data.

Thus, when these-secondary correction data Y2, M2 and C2 are added to the corresponding original data Y0, M0 and C0 by means of respective adders 6Y, 6M and 6C and under proper selection of weight coefficients $k_{ij}$ for primary color correction circuit 8, any color discrepancy of the ideal color of the ink appearing on the printed picture images under the action of the sublimation transfer printer can be arbitrarily ammended. In this case, when the weight coefficients $l_{ij}$ for the secondary correction circuit 9 are selected out properly, the color tone of the printing picture images can be modified to an arbitrary degree.

Further, as for the black color data K, correction data K2 can be calculated by the following formula. With use of these correction data K2, which are added to the original black color data K, the desired correction can be executed in a similar manner.

$$K2=K+\mathrm{ml}\cdot\Delta B+m2-\Delta C+m3\cdot\Delta G+m4\cdot\Delta Y+m5\cdot\Delta R+m6\cdot\Delta M$$

wherein, Mi represents weight coefficients:

$i$=1–6.

In this way, output data: Y, M, C and K delivered from the color correction circuit 4 are introduced into the gradation corrector 10 as inputs thereof, and each constituent of these data can be subjected to correction as desired.

Figure 7:
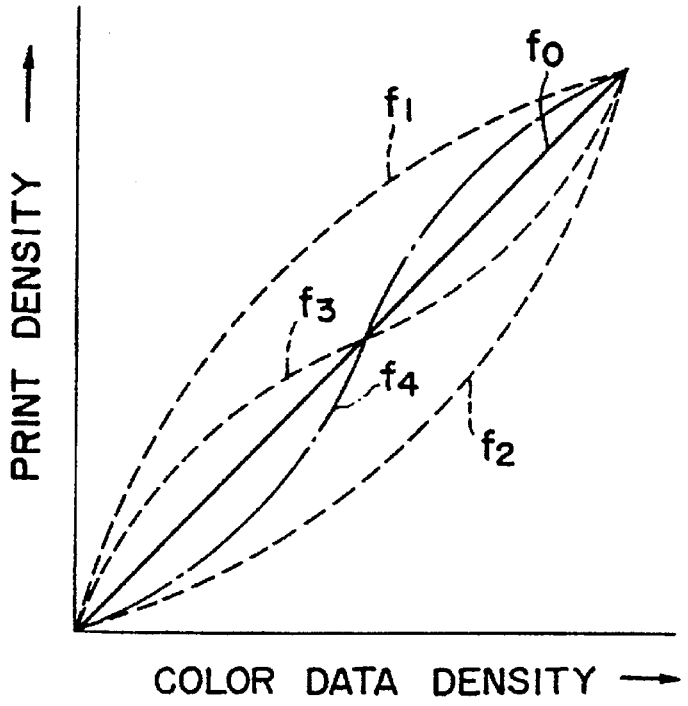
FIG. 7 is a graph showing operational characteristics of a color tone or -gradation corrector unit shown in FIG. 3A.

FIG. 7 shows several characteristic curves illustrating corrections by means of the gradation corrector 10. More specifically, f0 represents a standard characteristic curve; f1 a highlight-stressing operation curve; f2 a shadow-stressing operation curve; f3 a highlight-and-shadow stressing operation curve; and f4 a medium tone stressing operation curve.

As indicated in FIG. 7, by presetting, as necessary, the tone-reproducing characteristics, which determine the relationship between that concentration of color data and that of the prints printed by means of a sublimation image transferring printer, a color tone similar to that possessed by the original image can be reproduced. More specifically, when no correction is adopted, the curve f0 is used, while in the case of correction, any selected one of these curves f1 to f4 may be utilized depending upon the part of gradation to be stressed. Further, it should be noted that the tone reproducing characteristic curves are not exclusively limited to those which have been specifically shown and described above. As an example, the control of gradation correction by color tone reproducing characteristic mentioned above is executed by a gradation circuit, not shown, and the setting of the color tone reproducing characteristic is brought about by manipulation of any selected one of the control knobs, not shown, which are provided separately for "highlight"; "medium tone" and "shadow".

Y.M.C.K.-data subjected to correction by the gradation corrector 10 are once stored in the memory unit 11. The thus stored data may be read out from the memory for each color by manipulation of the selection switch 12 and, after provisional storing, per one line of transfer head 16, at the buffer 13, introduced into the parallel/series converter 14 for conversion thereby into corresponding series data.

Figure 3B:
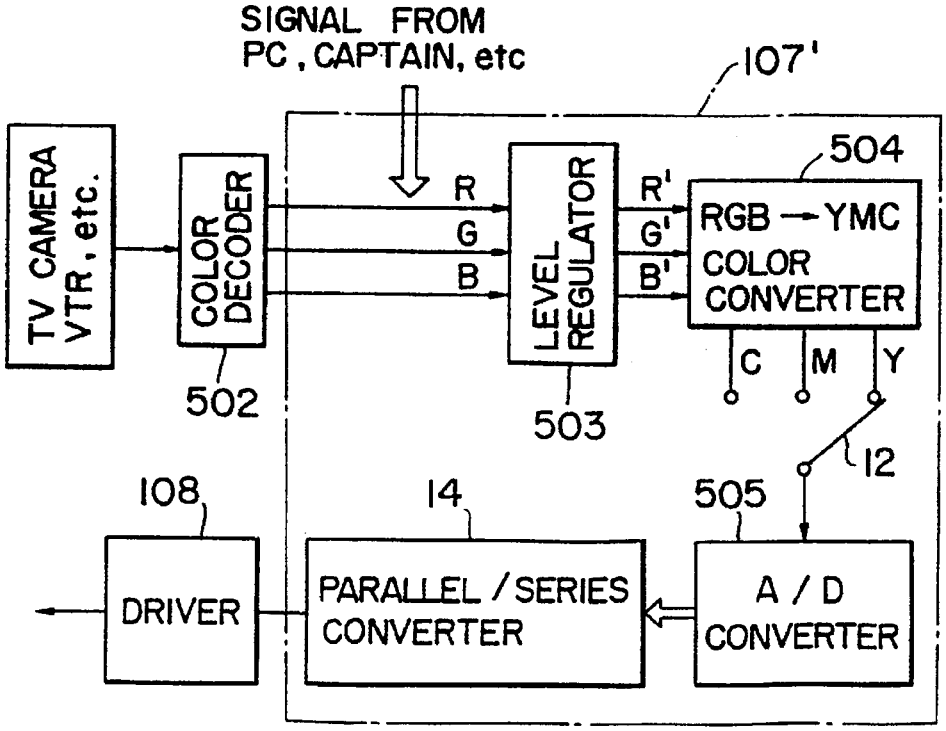
FIG. 3B is a block diagram of a sublimative image-transferring printer adopted in the present invention, as a preferred embodiment thereof.

Another example of the data processing circuit for the sublimation transfer printer is shown only schematically in FIG. 3B. As shown, the processing circuit in 107' comprises a level regulator 503; a color converter 504; an A/D converter 505 and a parallel/series converter 14.

As the image data introduced into the processing circuit 107', those which have been subjected to conversion into R.G.B.-signals in the color decoder 502 from composite video signals delivered from a T.V. camera, VTR or the like are used. On the other hand, R.G.B.-signals delivered from a personal computer, captain system or the like means are introduced as input into the level adjuster 503.

As the color correction method with the use of the foregoing arrangements, it is possible, more specifically, to adjust the hue saturation and/or brightness in the color decoder 502, or to adjust the signal level of each color light of R.G.B.-system in the level regulator 503.

As an example, the color conversion from R.G.B.- to Y.M.C.-system can be executed in the color converter 504. The simplest possible method in this color conversion is to procure the opposite color to each of the normal colors.

The thus produced color signals of Y.M.C.-system is subjected to A/D conversion and then fed successively through the parallel/series converter 14 and the driver 108 to the thermal head, not shown, to carry out printing in the sublimation transfer principle.

Additionally, in normal cases, with the use of the foregoing system composition, input image data must be of static mode. However, by provision of memory means in front of the color decoder or at an intermediate position between the A/D converter and parallel/series converter, animating images can be processed.

The series data converted in the foregoing manner in the data converter 107 or 107' are fed to the shift register SR shown in FIG. 6 by n-image elements and then, upon being subjected to latching in the latch circuit LT are further delivered to NAND gate NA as its inputs. When a strobe signal ST is fed as input to the NAND gate NA, the foregoing n-image element data is fed to the thermal element HE.

Figure 8:
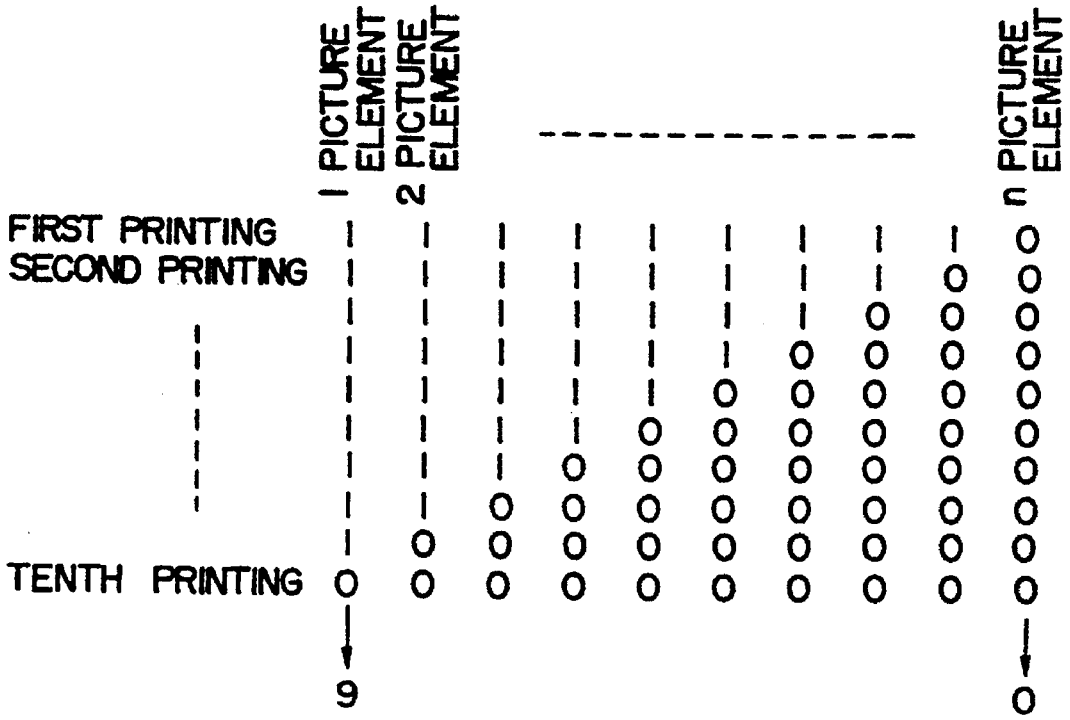
FIG. 8 is a table for the illustration, as an example, of picture- or image-elements, as expressed in binary signals.

FIG. 8 is a schematic diagram, showing signals for respective image elements. The gradation has been so selected that the first image element is at the highest gradation level, while the n-th image element corresponds to the lowest gradation level, and that the second to (n–1)th image elements vary linearly in gradation levels, so as to provide representatively a better understandable example of the invention.

Next, the operation of the parallel/series converter 14 will be described.

First, as shown in FIG. 5, image elements data A, consisting of parallel data, more specifically, comprising parallel eight bit data A0–A7, are fed to one-side inputs of comparator 22, while another side inputs thereof are fed with outputs B, comprising eight bit increment outputs B0–B7, of counter 23. The counter 23 counts clock signals in increments, the outputs B0–B7 being successively varied.

The comparator 22 performs comparison between the two inputs A and B, so as to deliver successively outputs of binary "1" until the increment output B is brought into coincidence with image elements data A, or more specifically, under the condition of A>B and A=B, while, thereafter, binary "0"-outputs are delivered therefrom. More specifically, comparator 22 will continue to deliver binary "1" until an increment value which corresponds to the weight of concentration of image element data A is given thereto. As an example, if the image element data A has a concentration of gradation 128 of a total 256, output "1" will be repeated to deliver 128 times first and then, output "0" will follow after again 128 times, so as to provide in total a specific series data peculiarly in this case.

These series data are taken out from the comparator 22 in the form of A>B- and A≦B-outputs and of A=B–outputs through an attributed OR-gate 24, and in the present example, the gradation consists of 256 steps or increments. However, in practice, the gradation may represent a smaller number of steps. As an example, if the incrementing bit is B1 instead of hitherto employed B0, the gradation will have 128 steps; and if B2 is employed, it will have only 64 steps. In this way, the gradation setting may be varied in a simple manner.

When in the foregoing way, the output B from the counter 23 is stepwise incremented, such series data consisting of a first series of "1" will be delivered until the relationship between the image elements data A and the output B from counter 23 becomes A=B, and of a second series of "0" issued thereafter, as shown in FIG. 8.

Figure 9:
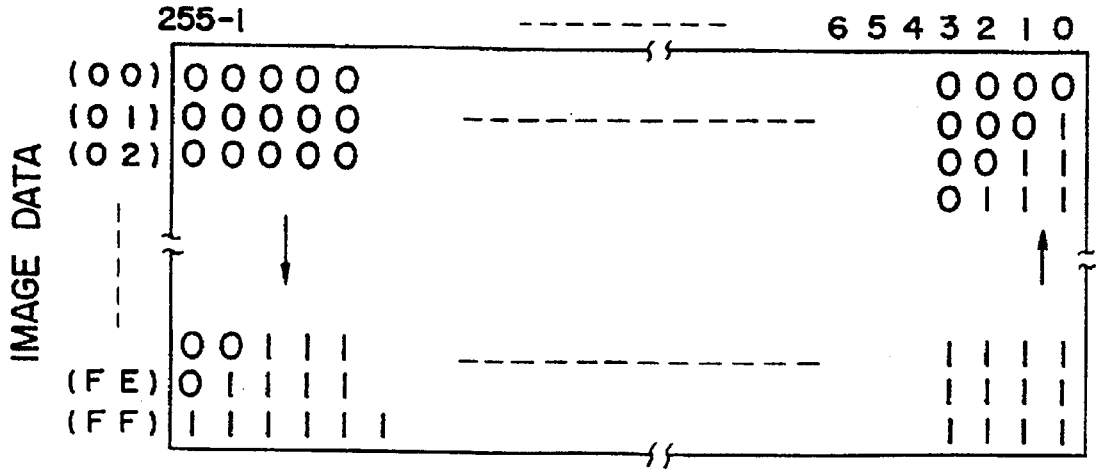
FIG. 9 is a table showing a conversion operation, as an example, of a parallel/series converter shown in FIG. 3A.

In FIG. 9, a conversion mode at the parallel/series converter 14, which, however, is different from that shown in FIG. 8, as an example, is shown again in the form of a matrix. As-shown, when the image data are of 8-bit parallel kind, as an example, the gradation data are ranged from 0 to 255, providing, therefore, binary series data from "00 . . . 00" to "11 . . . 11".

In this way, the data, per line in the transfer head 16, kept preserved in the buffer 13 are fed to the parallel/series converter 14 for providing as outputs therefrom into corresponding series data which are then delivered through the driver 15 to the transfer head 16 and thus recorded on a print paper P supported on the transfer drum 17.

Figure 10:
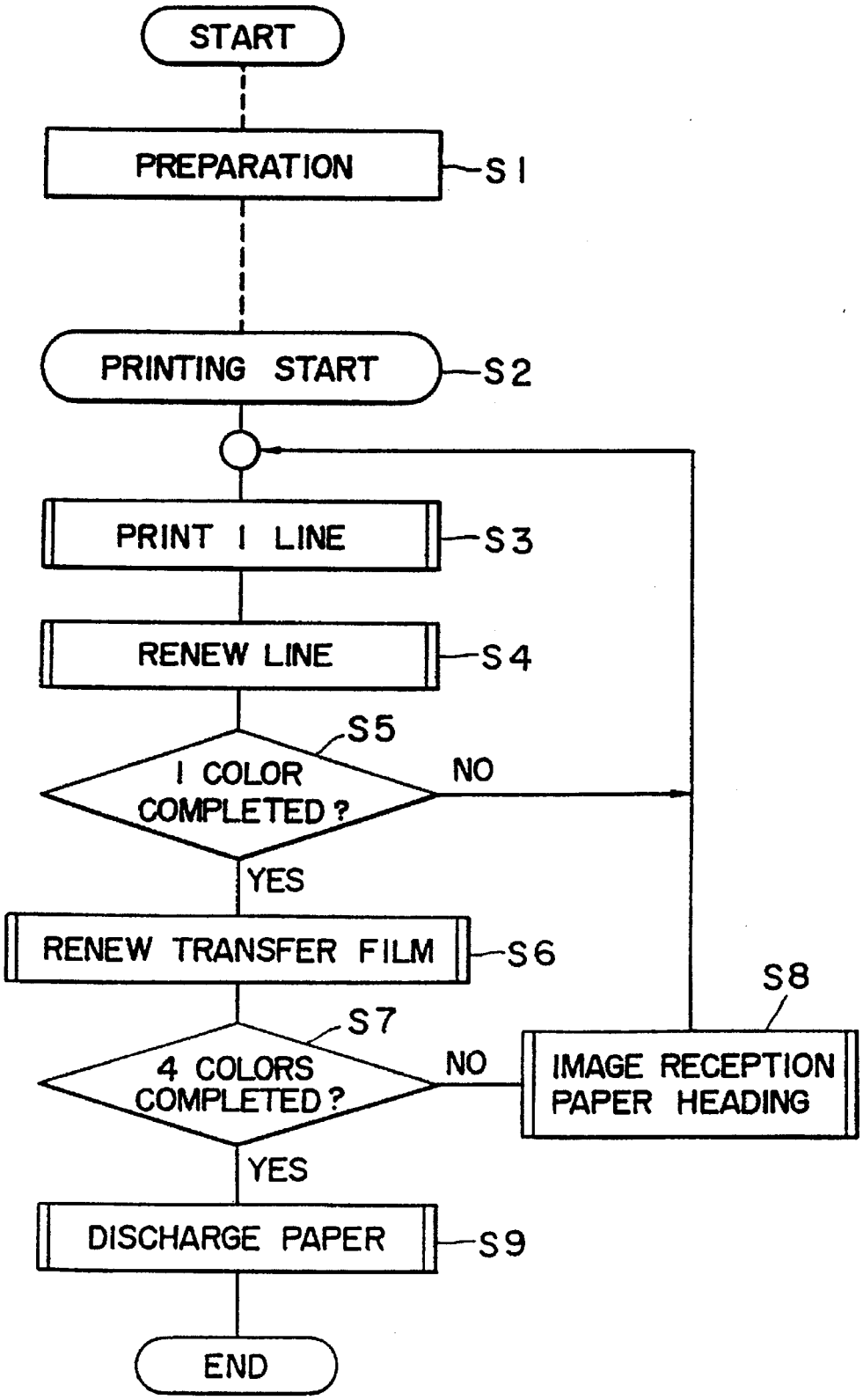
FIG. 10 is a flow chart, illustrating the operation of the sublimative image transfer printer.

FIG. 10 represents a flow chart illustrating the operation of the sublimate printer as employed in the present invention.

At the first step S1, print papers are set in position and the printing ribbon is also set in position ready for performing the required procedure.

At the second step S2, printing operation is initiated, and line printings are executed, line by line, accompanying necessary intermittent line shifts, with relation to any selected one of four colors: C (cyan); M (magenta); Y (yellow) and K (black) being carried out. Refer to S3 and S4. When line printings with the selected-out single color have been completed (S5), the image transfer sheet is replaced by another color sheet (S6) and so on. In this way, line printings are completed in all four colors. In this case, it is naturally most preferable to use a long extended single transfer sheet on which four color ink regions are repeatedly printed in a certain predetermined pattern. The image reception paper is initiated to make print from a certain prescribed position for each of these colors (S8). When all of the printing steps have been completed with the four colors, the paper is discharged from position (S9) and the printing operation is terminated to be repeated.

Figure 11:
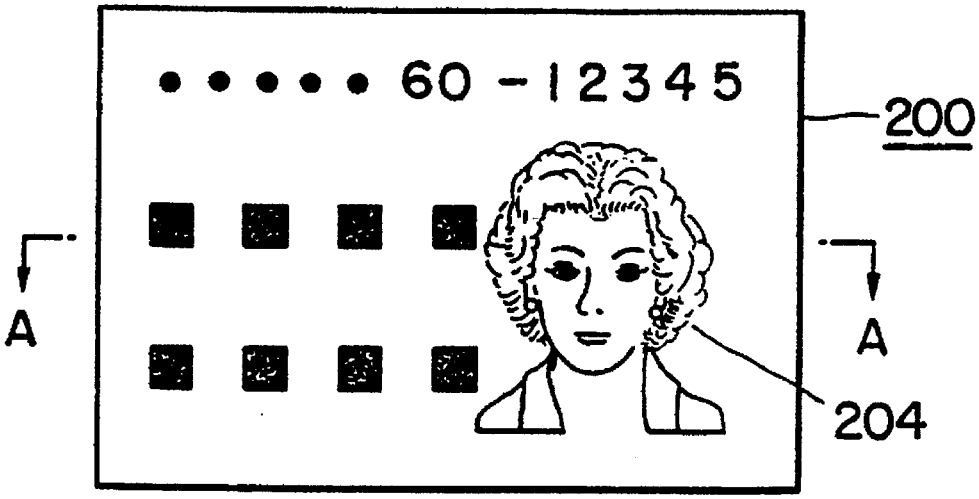
FIG. 11 is a plan view of a final decorative product prepared according to the inventive technique.
Figure 12:
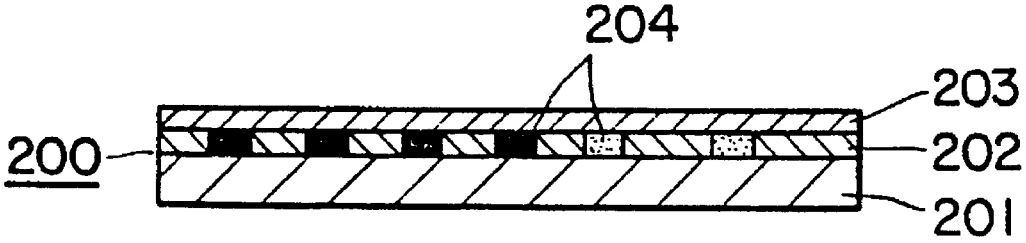
FIG. 12 is a sectional view of the product card shown in FIG. 11, and taken along a section line A—A shown therein.

In FIG. 11, a card style sample of the final products according to this invention is shown in front view at 200. FIG. 12 is a sectional view thereof. Numeral 201 represents the substrate material of the card; 202 a display layer; 203 a surface protecting layer; and 204 a display image as an example. Depending upon the kind of usage and when necessary, the protecting layer 203 may be dispensed with. It should be noted that the display image 204 on the display layer 202 is represented by a sublimative dyestuff, as a characterizing feature of the present invention.

As the main and substantial material of the image transfer sheet, various plain papers, converted papers, plastic resin sheets or the like may be used per se or in combination. When a plastic resin sheet which can be colored directly with a sublimative dye or dyes is used, these image transfer substrates (articles or objects) as at 201 can be united .each with the display layer 202. Each of these substrate materials, when it is of the card style, may have generally such dimensions: thickness of 0.68 to 0.80 mm and size: 11 to 8×8 to 5 cm.

As the material of the display layer 202, various known materials which may be colored with sublimative dyestuffs, such as polyethylene, polypropylene, polyester, ABS, AS, polyvinylchloride, polyvinyl/vinyl acetate copolymer, polystyrene, polyacrylate, polyester, polyamide, polyurethane and the like plastic material, may be advantageously utilized. As will be more specifically described hereinafter, this material layer can be united with the substrate material layer 201. In the case of such unified structure with substrate layer 201, the thickness and size dimensions may be substantially as the same as before. However, when normal and/or converted papers or metals, which are practically impossible to color with sublimative dyestuffs, are used as the substrate layer 201, various methods can be utilized for desired coloring. As an example, a solution including at least any selected one of plastic resin materials capable of coloring with sublimative dyestuffs may be coated on the substrate surface, or alternatively used in the form of a film which is laminated thereon. This kind of film preferably has a thickness of about 3 to 50 μm or so. One of main characterizing features represented in and by the final products 200 is that the appearing display image or images as at 204 is/are formed at least partially or wholly with a sublimative dyestuff or dyestuffs. Additionally, the process for formation of such images can be executed in the conventional art.

As an example, the processing method may be executed conventionally as follows.

As an example, a sublimative image transferable sheet, such as a paper sheet, plastic resin film or sheet capable of acting as the carrier is coated on its surface with any suitable binder resin carrier carrying sublimative a dyestuff or dyestuffs under heat, is overlapped on the display layer 202 and then subjected to heat from behind the heat-transferable sheet, preferably in the pattern mode, so as to transfer the dyestuff or dyestuffs into the display layer 202. It is proper to select the molecular weight of 250 or larger of the dyestuff, for improving the fastness thereof. However, a molecular weight higher than 370 is more favorable. In the case of provision of the surface protecting layer, there is practically no limitation to the selectability of the dyestuff molecular weight.

The sublimative image transfer may be executed directly on the surface of substrate 201 provided with the display layer 202. Or alternatively, a carrying, image transferable sheet is prepared separately and, after formation of the image 204 thereof, may be stuck onto or laminated on the substrate 201.

Image-carrying and image-transferable sheet

Figure 13:
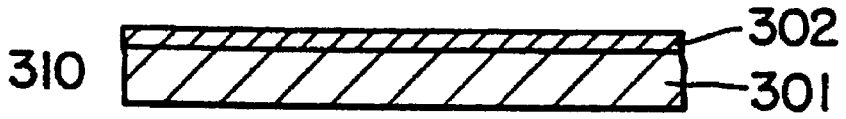
FIGS. 13 through 31 are a series of sectional views, respectively illustrating several structural examples of image-transferable sheets, suitable for use in the invention.

In the following, structure, material, usage and application purpose of the image-transferable sheet to be employed in the present invention will be described in detail:

FIG. 13 illustrates only basically and in schematic sectional view the image-transferable sheet adopted in the present invention, while FIGS. 14 through 19 and 22 through 24 illustrate preferable embodiments thereof.

The basic structure of the image transferable sheet 310 is characterized in that, as shown in FIG. 13, a sheet-like substrate 301 is provided at its one surface with an image-reception layer 302 capable of peel-off from the substrate. By adopting such a structural configuration of the image-transferable sheet, the image-reception layer 302 can be formed with the required image or images with the use of an image transferable sheet having thermally shiftable dyestuff, and then, the image-formed, image-reception layer 302 is peeled off from substrate 301 and attached firmly, preferably as by sticking, on the surface of any selected object or article with use of any suitable means. In this way, various conventional drawbacks inherent in the comparative conventional technique can be basically overcome.

More specifically, as the material of the aforementioned image-reception layer 302, limitation must be imposed to those which can be colored with thermally shiftable or transferable dyestuff. However, upon formation of necessary images and upon peel-off from the sheet-like substrate 301, the image-reception layer 302 may be attached fixedly onto the surface of glass-made, metal-made or wooden-made products or plastic-resin made ones which are very difficult to color with thermally shiftable and transferable dyestuffs, indeed, by reliance on conventional sticking techniques as properly adopted in consideration of the specific nature and kind of the material of decorative products to be ornamented. Further, the image-formed and peeled-off, image-reception layer 302 from the sheet substrate 301, is highly thin and thus sufficiently pliable so that it may be applied even onto any uneven and complicated surface of a product to be decorated or ornamented, having undulations, convexities, concavities, recesses and projections. Therefore, a maximum possible better fitness of the image-reception layer to be ornamented is attained and guaranteed by the present invention. Thus, practically no limitation in the attaching use thereof may be encountered. Further, in sharp contrast to conventional sealing seals and the like, the very thin image-reception layer bearing necessary images can be applied easily to the product per se in a very uniform manner, thus providing no raised and thickened feeling, and giving rise to no foreign feeling upon attachment.

Figure 14:
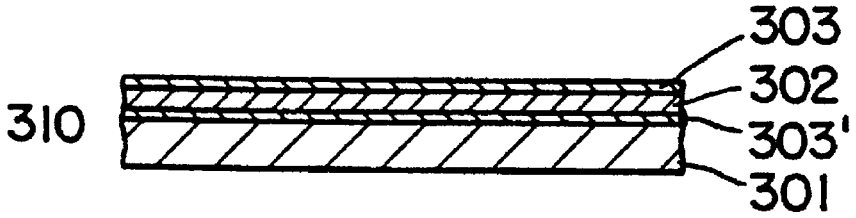

FIG. 14 shows a further example of the image transferable sheet 310. In this case, there is provided a parting agent layer 303 on the surface of image-reception layer 302. Between the latter and the sheet substrate 301, there is provided a parting agent layer 303'. If necessary, however, any one of the two layers 303; 303' may be dispensed with.

The first parting agent layer 303 is provided for prevention of thermal fusion between the image-reception layer 302 and an image transferable sheet, not shown, as may occur during image transfer and formation on the first layer 302 through transfer of thermally transferable dyestuff from the said transferable sheet to the first layer. If there is no risk of such thermal fusion of the above nature, or when the image-transferable sheet has been already provided with such a parting agent layer, the present provision thereof may be unnecessary. As for another parting agent layer 303', it is for the purpose of making the latter peel-off operation, to be executed after image-forming step, easier. When the sheet-like substrate 301 is made of polyester or the like material which has, as it is, sufficient separability from image-reception layer 302, provision of parting agent layer may naturally be dispensed with.

Figure 15:
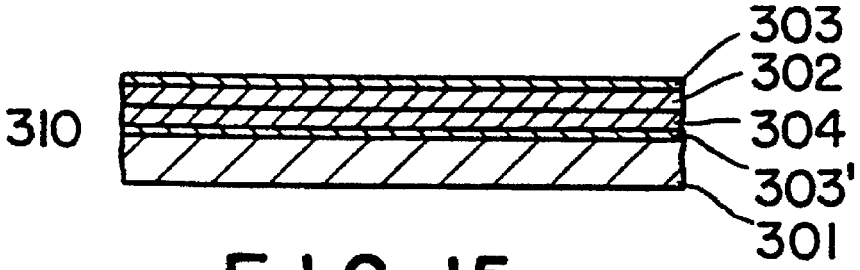

FIG. 15 illustrates a still further example of image transferable sheet 310. In this case, between the image-reception 302 and the sheet-like substrate 301, an intermediate layer 304 and/or parting agent layer 303' is/are provided. The laminating order is optional and thus not binding. The intermediate layer 304 will serve to assist the image formation to be rather firm and beautiful, the image formation being carried out by transferring the thermally shifting and transferring dyestuff from the image transferable sheet to the image-reception layer 302. For this purpose, the intermediate layer 304 may take, for example, the form of a cushioning layer or heat insulating layer. When a cushioning layer is provided as the intermediate layer 304, the cohesion between the image transferable sheet and the image reception layer 302 is greatly improved and the thermal shift and transfer of the dyestuff during image formation with the use of a thermal head is evenly executed, the image formation thereby being carried out amply in correspondence with the supplied image signals. Further, when a heat insulating layer consisting of a highly heat-insulative material is used as the intermediate layer 304, ineffective release of the heat applied during shift and transfer of the dyestuff from the image transferable sheet to the image-reception layer 302 can be reduced to a minimum possible, the effective thermal efficiency thereby being correspondingly improved and ample image formation being accelerated. If necessary, however, these cushioning layer and heat-øinsulating layer can be prepared independently and arranged concurrently in any arranging order.

Additionally, when the intermediate layer 304 is arranged at a higher level than the parting agent layer 303', the intermediate layer 304 will be conjointedly peeled off in the case of peel-off of the image-reception layer 302. On the contrary, when the intermediate layer 304 is arranged at a lower level than the parting agent layer 303', the intermediate layer will remain on the sheet-like substrate 301 after execution of the separation of image-reception layer 302. In this case, therefore, the intermediate layer 304 may be made preferably and at least substantially transparent, when the peeled-off image-reception layer 302 is stuck on a decorative product, while directing the surface of parting agent layer 303 towards the latter.

Figure 16:
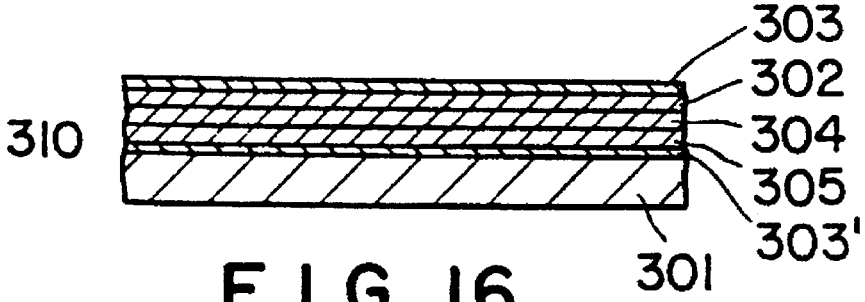
Figure 17:
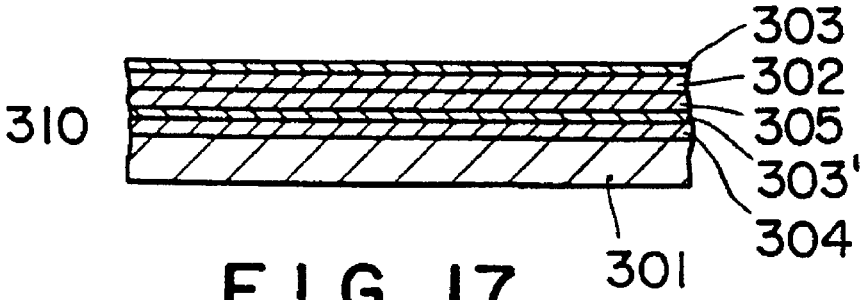
Figure 18:
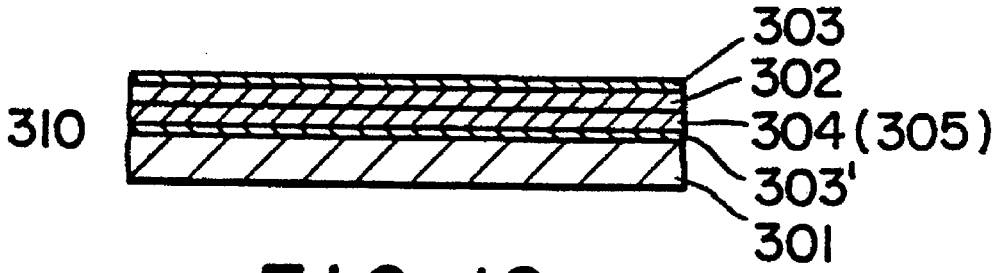
Figure 19:
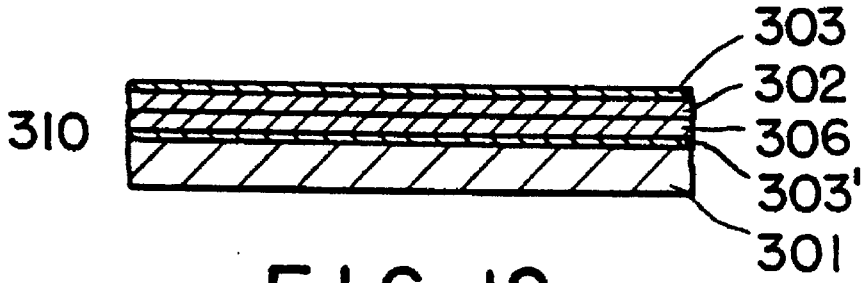

In the modifications shown in FIGS. 16, 17, and 18, modified from the foregoing embodiment shown in FIG. 15, a further protecting layer 305 is provided between the image-reception layer 302 and the sheet-like substrate 301. This protecting layer 305 serves to prevent deterioration of the formed images in the image-reception layer 302 when the latter is stuck on the decorating product while directing the surface (more specifically the image-formed surface) towards the product. For example, this protecting layer 305 is prepared from a superior material which exhibits at least one of desirous properties such as antiwearing, light-fast, weather proofing and anti-chemical qualities. With the use of the protecting layer 305 having these superior qualities, the images can represent improved fastness in the above various aspects, even after execution of the foregoing sticking procedure.

In the modification shown in FIG. 16, the protecting layer 305 is arranged between the intermediate layer 304 and the parting agent layer 303'.

In the further modification shown in FIG. 17, the protecting layer 305 is arranged between the image-reception layer 302 and the parting agent layer 303'.

In still another modification shown in FIG. 18, the intermediate layer 304 takes the role of the protecting layer 305.

In each of these modifications, the protecting layer 305 is arranged in neighboring relationship with the partition agent layer 303', whereby the image-formed and remotely arranged, image-reception layer 302, kept in its up-and-down reversed state, is capable of adhering securely to the decorative product, so as to be positioned as an uppermost layer, as may be required. In a still further modification shown in FIG. 19, derived from that shown in FIG. 14, a sticking layer 306 is further provided between the image-reception layer 302 and the partition agent layer 303. It should be noted, however, that such a sticking layer as at 306 may be provided in any one of other foregoing examples and modifications, if necessary, in neighboring relationship with the parting agent layer 303'.

The provision of such a sticking layer as at 306 is highly valuable when the image-formed and peeled-off, image-reception layer is adhering without position reversal onto the decorative product. With this arrangement mode, the protecting layer 305 shown in FIGS. 16, 17, and 18 may be dispensed with. If, however, the protecting layer 305 is composed of a material in the form of a sheet-like substrate, the part to be peeled off is thereby strengthed, the peel-off procedure thus being greatly facilitated.

By previous provision of the sticking layer 306, the image-formed and peeled-off, image-reception sheet 302 can be caused to adhere as it is onto the decorative product without use of a separate sticking agent. As the sticking layer 306, an ordinary sticking agent which is active at room temperature can be used. Or alternatively, a heat-sensible or light-sensitive sticking agent may be used, if necessary.

In the foregoing, the main structure of the image transferable sheet employed in the present invention has been described in detail. However, other structural modes than those set forth hereinbefore which occur easily to those skilled in the art may be employable in the invention, and thus they may be included within the scope of the invention without departing from the appended claims.

It should be further noted that, in the present invention, the sheet-like substrate may be provided on its one surface with an image-transferable layer capable of peeling off through the intermediary of only one weakly sticking layer.

Figure 22:
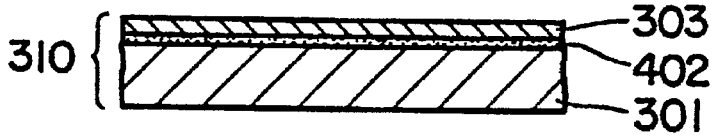

FIG. 22 shows only schematically in a sectional view a preferred embodiment of such an image-transferable sheet, denoted with same reference numeral 310.

As shown in FIG. 22, the image-transferable sheet 310 represents a basic structural characteristic such that any suitable sheet-like substrate 301 is provided on one of the surfaces with an image-reception layer 302 through an only weakly sticking intermediate layer 402, the layer 302 thus being easily peeled-off when desired. By providing the image-transferable sheet with such a structural characteristic as set forth above, desired positive or negative images are formed by transferring thermally shiftable and transferable dyestuff from the image heat transferable sheet to the image-reception layer 302, and the thus image-formed layer is peeled off from the sheet-like substrate 301 and then attached onto any suitably selected product with the use of proper means or attached per se thereon without the peeling-off operation, the substrate then being peeled off, whereby an image-formed final product can be obtained.

In the foregoing example, it should be noted that the image reception sheet 302 per se has only a thin thickness and thus represents only poor feedability during the sheet-feeding period within the printer at the time of image formation, insufficient cushioning effect and only insufficient thermal efficiency during the printing operation, and further, it is very difficult to treat in advance of as well as after execution of the image formation. Therefore, the coexistence of the image-reception layer 302 and the sheet-like substrate 301 is absolutely necessary. In addition, it is a requisite requirement that the image reception layer 302 be easily peeled off from the sheet-like substrate 301 upon execution of the image-forming operation, and thus, the layer 302 and the sheet 301 should not be stuck too strongly together. In order to satisfy this requirement, provision is made of weakly stuck layer 402 therebetween. Thus, it should be noted that the term "weakly stuck" employed in this specification and appended claims may be defined as "to be separable by finger's end and the like means from each other without entailing destruction or breakage of the parts originally stuck together". It is worthwhile to say, in considering the relative relationship between the image-reception layer 302 and the sheet-like substrate 301, there is no necessity to provide the weakly-stuck layer 402 if the aforementioned peeling-off is very easy to bring about.

Figure 23:
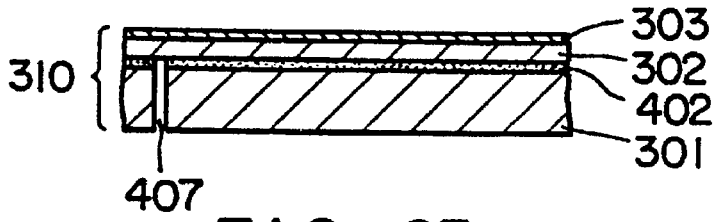

FIG. 23 illustrates still another modification of the image-transferable sheet 310 denoted by the same reference numeral 310 only for simplicity and convenience, wherein a further parting agent layer 303 is provided on the surface of image-reception layer 302.

This layer 302 is provided for occasional thermal sticking between the thermal image transferable sheet, not shown, and the image reception layer 302 in the progress of thermal shift and transfer of the dyestuff from the sheet to the layer 302. This provision of the parting agent layer 303 may be dispensed with if there is no risk of occurrence of such disadvantageous sticking attachment or the sheet under consideration has already been fitted with such a parting agent layer.

Figure 24:
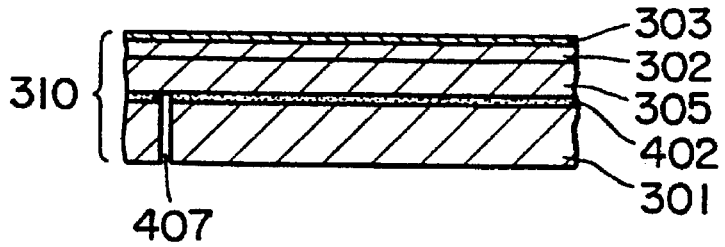

A modification shown in FIG. 24 from that shown in FIG. 23 has such a modified structure that a protecting layer 305 is provided between the image-reception layer 302 and the weakly stuck layer 305. This layer 305 serves to prevent otherwise occurring deterioration of the images at the image-reception layer 302 which has been formed with preferably reversed images and subjected to peeling-off, together with protecting layer 305, preferably a plastic sheet layer, from the sheet-like substrate 301 and finally stuck onto the decorative product, while directing the image-formed surface of the image-reception layer towards the product. The protecting layer 305 is .made of a material having various excellent physical properties, such as anti-wearing-, light-fastness and antichemical characteristics. Provision of such a protecting layer improves various fastness performances of the formed images after sticking attachment of the image-reception layer 302.

When necessary, a separate parting agent layer, not shown, may be provided between the protecting layer 305 and the weakly stuck layer 402 for providing easy peel-off capability between these two layers 305 and 402, as being applicable to the example shown in FIG. 24. If the surface of the protecting layer 305 should have sufficient peel-off capability, it is natural to provide such an intermediate parting agent layer as above.

Further, in the case of the image-transferable sheet 310, it is naturally easy to separate from each other through a peel-off operation, upon the formation of necessary images thereon and before practical use thereof as the image-transfer sheet, and a cut-out slit as at 407 in the sheet-like substrate 301 may be provided for attaining such an easy separation as stated above at a portion of the sheet 310 in proximity to one end thereof. Upon the provision of such a cut-out slit as at 407, the thus formed flap-like portion can be easily folded out by the operator's finger-tip, thereby affording convenience in a peel-off operation.

The usable materials and composing methods of the foregoing image transferable sheets will now be described.

As a material usable for the sheet-like substrate may be any one or any combination of the following categories:

(1) synthetic paper (polyolefin-series; polystyrene series and the like);

(2) fine quality paper; art paper; coated paper; cast-coated paper, wall paper; back-up paper; backing paper; resin-, emulsion- or synthetic rubber-imprignated paper; resin-admixed paper; paper board; cellulose fiber paper;

(3) polyolefin-, polyvinyl chloride-, polyethylene terephthalate; polystyrene; polymethacrylate; polycarbonate and the like plastic film or sheet.

Use of the synthetic paper belonging to the foregoing category (1) is highly suitable for the purpose of the present invention since the surface thereof generally represents a microvoid layer which provides a low heat conductivity and thus a high heat-insulating peformance. A laminated material representing any combination of the foregoing categories (1), (2) and (3) can be used in the present invention. A representative and recommendable example of such a laminate is that of cellulose fiber paper and synthetic paper or that of cellulose fiber paper and plastic resin film or sheet. Among others, use of the first mentioned kind of laminate will provide an advantage in that the thermal instability such as thermal elongation or shrinkage possessed by the synthetic paper component is compensated for by the cellulose fiber paper, whereby a high thermal sensibility is demonstrated during the printing step due to low thermal conductivity of the synthetic paper component. Further, in the case of the present paper combination, however, a further modified combination of a three-layer laminate: synthetic paper-cellulose fiber paper-synthetic paper may be more advantageously employed for making the frequently appearing lesser by providing a well-balanced structure between both the surfaces of the final laminate.

As the synthetic paper mentioned above, any suitable one usable as a synthetic paper substrate used as a component of the image-transferable sheet layer may be used. As a recommendable example thereof, having a fine porous fine paper structure layer, the synthetic paper called "YUPO", manufactured and sold by Oji Yuka Goseishi Kabushiki Kaisha, Tokyo, may be mentioned. This paper layer having a fine pore structure may be prepared in such a way that a suitable plastic resin material containing a filler of finely divided state is subjected to a mechanical elongation step. When the image-transferable sheet composed of the synthetic paper sheet containing finely divided air as above mentioned is formed with images through a thermal image transfer setp, the concentration of the thus formed images is surprisingly high and no fluctuation of image configuration and concentration is encountered, thanks to the heat insulation effect provided by the very existence of fine air pores, in addition to the improved thermal energy efficiency. Especially, due to the advantageous cushioning effect provided by the air-filled fine pores, the image-receiving layer is supposed to be rather advantageously affected during the image formation step. As an alternative measure, the paper-like layer containing the above-mentioned fine air pores may be, if desired, provided directly with the core material consisting of the cellulose fiber paper or the like.

It is further possible to use plastic film in addition to the cellulose fiber paper in the laminate described above. Still further, a laminate of said cellulose fiber paper and plastic film composed together can be used.

As the method for co-sticking of synthetic paper and cellulose fiber paper, use of a known adhesive agent is naturally adopted, as an example. Or alternatively, the extrusion-laminating, heat-adhesion, or the like process may be relied upon, as the case may be. On the other hand, as the sticking-process between the synthetic paper and the plastic film, the lamination process to be carried out simultaneously with the formation of the film may be adopted. Calendering or the like method may be utilized for the same purpose. Selection of any suitable one of the several foregoing sticking processes depends upon the kind of material or the like condition of the partner member to be stuck together with the synthetic paper. As for the adhesive agent mentioned above, emulsion adhesive such as ethylene-vinyl acetate copolymer, polyvinyl acetate or the like, aqueous solution type adhesive polyester containing carboxyl radicals; or the like may be mentioned. On the other hand, as the laminating use adhesive, organic solvent solution type one such as polyurethane-, acrylic- or the like, may be mentioned.

The material for the image-reception layer must be suitable for reception of heat-transfer dyestuff, such as sublimative disperse dye from the image transfer sheet and holding and maintaining the thus formed images thereon. From the view point of image-holding and blocking prevention, use of such synthetic resin as having glass transition temperature higher than 40° C. may be advantageous. For example, the synthetic resins set forth in the following items (a) through (e) may be used separately or in combination.

(a) Ester bond-bearing resins:

Polyester resin; polyacrylic ester resin; polycarbonate resin; polyvinyl acetate resin; styrene acrylate resin; vinyltoluene acrylate resin and the like.

(b) Urethane bond-bearing resins:

Polyurethane resin and the like.

(c) Amide-bond carrying resins:

Polyamide resins (nylons).

(d) Urea-bond carrying resins:

Urea resins and the like.

(e) Other high polar-bond carrying substances:

Polycaprolacton resin; polystyrene resin; polyvinylchloride resin; polyacrylonitrile resin and the like.

The image-reception layer may be prepared from a resin mixture of saturated polyester and vinyl chloride-vinyl/acetate copolymer. As the saturated polyester, such commercialized products: "Vylon 200"; "Vylon 290"; "Vylon 600"; "Vylon 103" and the like, manufactured and sold by Toyoboseki K.K., Osaka, Japan; "KA-1038C" (manufactured and sold by Arakawa Kagaku K.K., Osaka, Japan; "TP 220"; "TP 235", manufactured and sold by Nippon Gosei K.K., Osaka, Japan; may be advantageously used. The vinyl chloride-vinyl acetate copolymer may have preferably 85–97 wt. % of vinyl chloride component, the polymerization degree being between about 200 and 800. The vinyl chloride-vinyl acetate copolymer may further contain a vinyl alcohol component, maleic acid component within the purpose of the invention in addition to the main components. According to our experiments, it has been found that these modified copolymers should have rather superior compatibility with polyester resin. The image-reception layer may be, if necessary, composed of polystyrene resin, for example, in this case, styrene monomer, preferably styrene, α-methyl styrene, and vinyl toluene may be used separately or in the form of copolymer or saying in general sense polystyrene resin. Further, such styrene copolymer resin may be used as specifically recommendable material in the above sense, comprising said styrene monomer(s) with other monomer, preferably for example, acrylic acid ester, methacrylic acid ester, acrylonitrile, methacrylonitrile and the acrylic or methacrylic monomer, or further styrene copolymer resin comprising maleic acid anhydride.

It should be noted, however, that among others, polyester series resin is especially superior for the purpose of the present invention.

In any of the foregoing embodiments, however, white pigment is preferably admixed with the material of the image-reception layer for improving the whiteness thereof and further accentuating the sharpness and fineness of the images when transferred thereto and to provide a manually writing-on performance. As the white pigment for this purpose, the following materials may be used separately or in any combination: titanium oxide; zinc oxide; china clay calcium carbonate; finely divided silica and the like.

For further improving the whiteness fluorescent whiteness-increasing agent or -bleaching agent may be added to. Further, for improving the light fastness of transferred images, ultraviolet absorption agent and/or photostabilizing agent may be added to, preferably in a quantity of 0.05 to 10 and 0.5 to 3 weight parts per 100 weight parts of the material resin composing the image-reception layer.

The image-transferable sheet used in the present invention is preferably constituted for improving the separability from the image-transfer sheet in such a way that the surface of the image-reception layer is formed with a partition agent layer, or instead, such agent is admixed to the image-reception layer. As for the partition agent to be used for this purpose, polyethylene wax; Amido Wax, Teflon Powder or the like solid wax; surface active agents such as fluorine-contained agent or phosphoric acid ester series surfactant; silicone oil or the like may be selectively used. Among others, silicone oil may be advantageously utilized.

The silicone oil may be used in oily state, but a hardenable type thereof may be rather advantageous. As the hardenable silicone oil, reaction-hardening one, photo-hardening one, catalytically hardening or the like one may be used selectively according to necessity. However, use of the reaction-hardenable one is most highly recommendable. Silicone oil of this type may be obtained, as example, by reacting amino-modified silicone oil with epoxy-modified silicone oil to obtain a reaction-hardened product. As for the amino-modified silicone oil, "KF-394", "KF-857", "KF-858"; and "X-22-3680"; "X-22-3801C" (manufactured and sold by Shinetsu Kagaku Kogyo K.K., (Tokyo, Japan)) and equivalents thereof may be used. As for the epoxy-modified silicone oil, "KF-100T"; "KF-101"; "KF-60-164"; and "KF-103" (manufactured by Shinetsu, above mentioned) and equivalents thereof may be used. Further, as the catalytically hardenable and photohardenable silicone oils in the above sense, "KS-705F"; "KS-770" of the catalytic hardenable or hardened silicone oils, manufactured by Shinetsu; and "KS-720" and "KS-774" of the photo-hardenable or hardened silicone oils (manufactured equally by Shinetsu) and equivalents thereof may be used. The adding quantity of each of these hardenable or hardened silicone oils may advantageously range from 0.5 to 30 wt. % depending on the material of the resin composing the image-reception layer.

At least a part of the image-reception layer is coated with a solution or dispersion of any of the foregoing partition agents in a suitable solvent and dried and further treated, a suitable parting layer being provided thereon. A particularly suitable partition agent for the formation of this kind of partition layer is the aforementioned reaction type hardenable one obtainable by reacton of an amine-modified silicone oil with an epoxy-modified one. The thickness of the partition layer is 0.01–5 μ, preferably 0.05–2 μ.

It should be noted that when silicone oil is admixed during formation of the image-reception layer, the silicone oil will bleed out after coating and the parting agent layer can be formed by the hardening even after such bleeding. In order to improve the parting ability between the image transferable layer and sheet-like substrate, it is possible to provide a parting layer consisting of a heat-hardenable resin, preferably of the melamine series, and having better affinity for the image transferable layer compositions. For the same purpose as above, however, without special provision of the parting layer, a protecting layer consisting of polymethyl methacrylate resin or cellulose acetate propionate can be provided.

For the formation of the image transferable layer, a solution or dispersion of a material composition suitable for the purpose is applied on the sheet-like substrate through conventional coating or printing. As an alternative way, a separate film or sheet for the image transferable layer 302 is formed preparatorily on a provisional carrier sheet or film and then, as a succeeding step, subjected to an image-transfer onto the substrate.

The intermediate layer is made of either a cushioning or a porous material. In some cases, the intermediate layer may additionally function as the adhesive layer.

The cushioning layer is mainly composed of such a resin which has a value of 100%-modulus as defined at JIS-K-6031 (Japanese Industrial Standard) of less than 100 kg/cm$^2$. If this value should exceed the above prescribed value, the rigidity will become much higher than that recommended for the intermediate layer. When the layer is formed with such disadvantageous material resin, sufficient adhesion between the heat image-transfer sheet and the image-reception layer cannot be maintained during the printing step. The lower limit of the prescribed 100%-modulus is of the order of 0.5 kg/cm$^2$ in actual practice.

Preferable kinds of resin to be used for the above purpose, may be enlisted as follows:

polyurethane resin; polyester resin; polybutadine resin; polyacrylic acid ester resin; epoxy resin; polyamide resin; rosin-modified phenol resin; terpene phenol resin; ethylene/vinylacetate copolymer resin; and the like.

These resins can be used independently or in combination of two or more kinds. Since these resins are rather viscous and tend to give rise to manufacturing troubles inorganic additives may be admixed, such as, for example, silica; alumina; clay; calcium carbonate; amide series substance such as amide stearate; and/or the like.

The cushioning layer is preferably formed with the use of one or more of the above specified resins, occasionally with the addition of suitable additive(s); solvent or diluent, prepared into a coating agent or printing ink which is then applied on, according to a known coating or printing process and then subjected to drying to provide a coating. The thickness of the coating should be between 0.5–50 μm, preferably 2–20 μm or so. With a thickness less than 0.5 μm, the coating will not be able to compensate for the surface irregularities on the substrate, thus being ineffective for the desired purpose. On the other hand, when the thickness exceeds the above specified maximum value or more specifically 50 μm, the overall thickness of the image-transferable layer becomes much too large, so that handling troubles may be encountered during wind-up and overlapping procedures, without attaining further effect as desired. In addition, in this case, a loss of production economy will be inevitably introduced.

The thus obtainable improvement of intimate adhesion between the heat-image transfer sheet and the thermally image-transferable sheet by the provision of the above intermediate layer may .be conceivably attributed to the lower rigidity of the intermediate layer per se, whereby it is liably to be deformed under the influence of the printing pressure, and further to the generally relatively low glass transition temperature and softening temperature of the aforementioned kinds of resin resulting in further lowering of rigidity and tendency to deform than at room temperatures upon reception of heat energy during the image printing step.

The porous layer may be formed generally in the following four ways: 1) through 4).

1) Emulsion of polyurethane or the like resin, methylmethacrylate-butadiene series synthetic rubber latex is foamed by mechanical agitation, coated, and dried on the sheet substrate into a layer.

2) The synthetic resin emulsion or synthetic rubber latex is admixed with a .foaming agent and the liquid mixture is coated and dried on the substrate into a layer.

3) Vinyl chloride-plastisol, polyurethane or the like synthetic resin or styrene-butadiene series or the like synthetic rubber is added with a foaming agent and the liquid mixture is coated on the substrate and subjected to heating to provide a foamed layer formed thereon.

4) A thermoplastic resin or synthetic rubber is dissolved in an organic solvent to provide a solution, and a non-solvent (including that containing aqueous main component), and the latter solution are mixed together to provide a liquid mixture, said nonsolvent being less volatile than the organic solvent and having a considerable mutual solubility with the solvent, and showing, however, non-solubility with the thermoplastic resin or synthetic rubber. The thus prepared liquid mixture is then coated on the sheet-like substrate and dried, to provide a porous membrane upon micro-coagulation of the constituents. The resulting microporous layer can be utilized for the above purpose.

It should be noted that the layers produced by any of the foregoing three processes 1) to 3) have rather large foams contained therein, and thus when the foaming solution for the image-transferable layer is applied thereon and dried, the latter may exhibit excessively coarse surface conditions. Therefore, in order to obtain an optimumly image-transferable smooth surface capable of providing transferred images of high uniformity, provision of the micro-porous layer prepared by the process as set forth in the foregoing item 4) is highly recommendable.

As the thermoplastic resin suitable for the formation of the above porous layer, saturated polyester; polyurethane; vinylchloride-vinylacetate copolymer; cellulose acetopropionate and the like can be used. Further, as the synthetic rubber usable for the same purpose, those of styrene-butadiene series, isoprene series, urethane and the like series may be used. Still further, as the organic solvent and non-solvent liquid used for the formation of the microporous layer, various known substances may be used. Generally speaking, however, methyl ethyl ketone; alcohol and the like are representatively used. On the other hand, as the non-solvent, water is mostly used.

The thickness of the porous layer usable in the present invention is preferably greater than 3 μm, especially preferably in the range of 5 to 20 μm. With the use of a porous layer having a thickness of less than 3 μm, the desired cushioning and heat-insulating effects cannot be attained.

As was referred to hereinbefore in the description stage for the formation of the image-transferable layer, the intermediate layer may act simultaneously as the sticking layer in some cases.

This kind of intermediate layer(s) may be provided on one or both of the surfaces of the thermally image-transferable sheet.

In practice, however, an electrostatic charge may accumulate in the material of the thermally image-transferable sheet during its processing step or during running through the printer. As a countermeasure, a proper antistatic agent may be applied on one surface of the image-transferable layer or on the bottom surface of the thermally image-transferable sheet or it can be included in the material of the image-transferable layer. As the antistatic agent in this sense, a surfactant such as a cation-exchange agent (for example, a quaternary ammonium salt, polyamide derivatives and the like) may be advantageously used. Further, an anion exchange type surfactant, such as alkyl sulfonate may be used. Otherwise, amphoteric ion type surfactants or even, nonionic surfactants may be used for the same purpose.

On the other hand, the antistatic agents may be coated on the surface of image-reception layer by gravure-coating, bar-coating or the like process or alternatively, these agents may be kneaded with the material resin and then subjected to transfer towards the surface during the coating formation and drying step for preparing and providing the image-transferable layer. As the antistatic agents to be admixed with the image-transferable layer material resin, cation-type acrylic polymers may be employed.

The protecting layer is peeled off together with the image-transferred layer, from the sheet-like substrate, and then stuck, in inverted reversed state, onto any desired decorative object, the protecting layer thereby being positioned at the uppermost position, for improving the anti-wearing-light-proofing and anti-chemical performances of the image-bearing layer. As the material adapted for the formation of the protecting layer, for example, alkyd resin; phenol-modified alkyd resin; aminoalkyd resin; phenol resin; urea resin, melamine resin; silicone resin, thermosetting acryl resin, thermosetting polyurethane resin and the like thermosetting resin or normal temperature setting resin; further, ultraviolet hardenable resin; electron ray hardenable and the like activating energy flux hardenable resins or thermoplastic resins such as polyester-; polyurethane-; polyvinyl acetate resin; vinyl chloride-vinyl acetate copolymer resin; polyolefin resin, acryl resin and the like, can be used.

Preparation and use of a protecting layer comprising one or more of the above-mentioned resins are made in such a way that the material resin is dissolved in a properly selected solvent according to the necessity, so as to provide a coating liquid or ink, as the case may be, which is provided between the parting layer and the image transferable layer. The thickness thereof is generally 0.5 to 20 m. It is also possible to form the protecting layer with the use of a resin film which consists of polyester-; acryl-; acrylpolyol-; polyvinyl chloride-; olefin resin or the like resin. It is further possible advantageously to admix an ultraviolet ray absorbing agent and/or photostabilizer to the material of the protecting layer.

The protecting layers prepared and formed in the foregoing way are thus not made integral with the sheet-like substrate or parting layer and, therefore, the peel-off operation of the sheet-like substrate upon execution of the image transfer is very simple and easy.

It is further recommendable, if necessary, to provide a slip-promoting layer on the bottom surface of the sheet-like substrate, which surface is naturally the one opposite to the image-transferable layer side, so as to properly adjust the friction between the image-transferable sheet and feed roll paper or carrier belt acting during passage through the printer and to improve the running performance of the thermally image-transferable sheet in the printer.

The slip-promoting layer can be formed by adding an organic powder such as polyethylene wax fluorine resin powder or an inorganic powder such as talc, according to necessity, to a resin such as polymethyl methacrylate resin; vinyl chloride-vinylacetate copolymer; vinyl chloride copolymer; cellulose acetate butylate; cellulose acetate propionate; styrene-acryl series or the like resin and kneading the resulting mixture to prepare a composition, applying this composition as a coating on the sheet substrate either directly or after application of a suitable primer treatment, and drying the coating thus applied. A suitable quantity of the slip-promoting layer is 0.5 to 5 g/m$^2$ after drying.

In the embodiments shown in FIGS. 22, 23, and 24, as the adhesive agent to be used in the slightly weak or weak adhesive layer, it should be noted that those conventionally used adhesives for adhesive tapes and seals can all be used. Preferred examples are polyisoprene rubber; polyisobutyl rubber; styrene butadiene rubber; butadiene acrylonitrile rubber and the like rubber-series resins; (meth)acrylic acid ester-series resins; polyvinyl ether-series resins; polyvinyl acetate-series resins; vinylchloride-acetate copolymer series resins; polystyrene-series resins; polyester-series resins; polyamide-series resins; polychlorinated olefin-series resins; and polyvinyl butyrol-series resins. To the suitably selected adherent may be added a proper quantity of a stickness improver, such as rosin; dammar; polymerized rosin; partially hydrogenated rosin; ester rosin; polyterpene-series resins, terpene-modified substances; petroleum-originated resins; cycropentadiene-series resins; phenol resins; styrene resins; xylene resins; and coumarone-indene resin. Further, when necessary, to the mixture may be added a softening agent, filler; antiaging substance or the like conventional agent(s). As the material for the formation of slightly or weak-adherent layer said above, emulsion type adhesive, preferably of acryl acid ester series can be used. As for the parting function after a long time of preservation, emulsion type adhesives are highly recommendable. These adhesive agents are easily procurable from market.

When necessary, these adhesives are added with proper organic solvent(s) for the adjustment of the viscosity, and then applied by roll coating, die-coating, knife coating, gravure coating or the like conventional technique on the surface of the sheet-like substrate, image-reception layer or protecting layer, so as to provide an adhesive agent layer. The thus formed adhesive layer is preferably of a thickness of 1–50 μm, although this is not limitative.

Formation of Images

In the following, the decorating process according to this invention will be set forth in detail. Utilization of the image-transferable sheet according to this invention constitutes an important main feature thereof.

Figure 20:
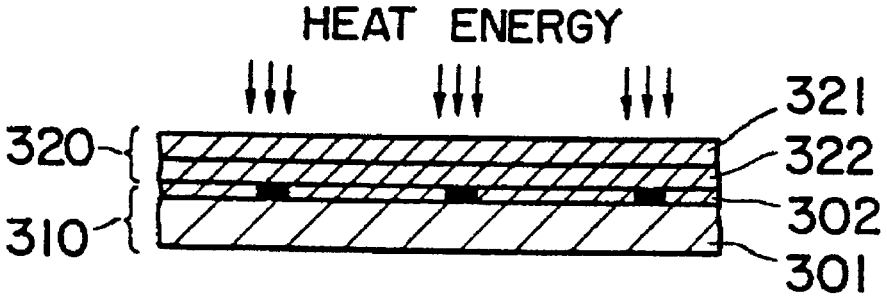
Figure 21:
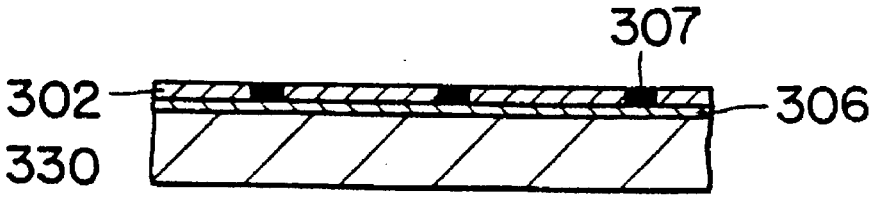

In FIGS. 20 and 21, basic practising processes will be described first.

The embodiment shown in FIG. 20 is a result of the use of the transferable sheet shown in FIG. 13. First, a known transfer sheet 320 is applied onto the image-transferable sheet 310 in an overlapped manner such that the dye-carrying layer 321 is kept in opposition to the image-reception layer 302 of image-transfer sheet 320, and heat energy is applied, as schematically shown by a plurality of arrows, in accordance with image signals fed at a thermal head, not shown, from the side of image-transferable sheet 310, or preferably, from the side of the image-transfer sheet 320, thereby forming the desired images as at 307 in the image-reception layer 302. Next, the image-reception layer 302 formed therein with the desired images 307 is peeled off from sheet-like substrate 301 and stuck onto the decorative product 306. Or alternatively, both the sheets 302; 301 are stuck onto the product 306 without preparatory peeling-off. In the latter case, the peel-off step may be executed after execution of the stickingly attaching step. In the above former case, and in such a case where an adhesive agent layer 306 has preparatorily provided between image-reception layer 302 and sheet-like substrate 301 as was set forth hereinbefore, the sticking attachment is carried into effect in such a way that the adhesive layer 306 is kept in opposing contact with the product 330, and then the sticking operation is brought about by application of heat and pressure or light and pressure, depending upon the nature and structure of the layer 306. In this way, the decoration according to the present invention is completed as a preferred one mode thereof.

On the other hand, if there is no preparatory provision of the adhesive layer, either the surface of product 330 or of the peeled-off image reception layer 302, may be coated with the adhesive agent, and the latter layer 302 per se or otherwise in the up-and-down reversed state may be stickingly attached onto the product 330 (refer to FIG. 21).

Since the image-reception layer 302 is composed generally of such thermoplastic resin material as is liable to be colored with thermally transferable dyestuff, it can be thermally and fusingly attached to plastic resin-made formlings, clothes or metals even with provision of an adhesive layer, if necessary.

Figure 25:
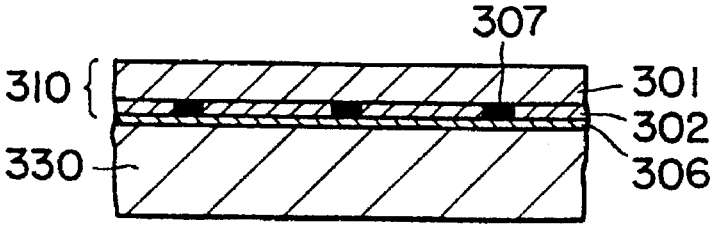

In this case, the image-bearing layer 302, the image thereof having been formed in the aforementioned way, is stuck on, through the intermediary of the adhesive agent layer 306 as shown in FIG. 25, while retaining the sheet-like substrate 301 on the surface of the image-reception layer 302.

Figure 26:
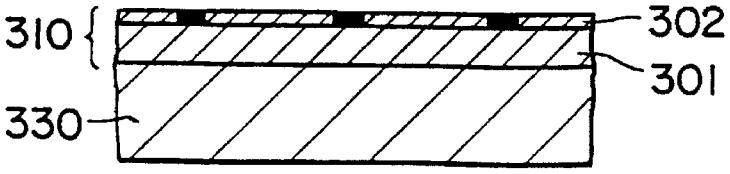

A modification of the last-mentioned mode is shown in FIG. 26. In this case, sheet-like substrate 301 is formed on the surface of the product 330 and the image-reception layer 302 is formed as the outermost layer. Further, in this case, sheet-like substrate 301 and product 330 may be stuck together, and, through the intermediary of a suitable adhesive layer, sticking layer or heat-sealable sheet or the like.

As for the transparent film usable as the said sheet-like substrate, it must be transparent to such a degree as not to conceal the images formed in the image-reception layer, and, in addition, it must have superior surface properties such as, for instance, antiwearing characteristics. As an example, polyolefine; polyvinyl chloride; polyethylene terephthalate; polystyrene; polymethacrylate; polycarbonate and the like plastic resin-made films may be used upon variously surface conditioning. If these transparent films should be too thick, the images will be raised, and the unitary feelings may be lost when these are stuck on respective products to be decorated. Therefore, the film thickness is preferably of the order of 0.5 to 50 μm.

In the case of a further embodiment of the present invention, the image reception layer of image transferable sheet which has been, however, formed with necessary images is subjected to image transfer treatment onto an intermediate image transferable substrate, the latter is then subjected to an image-retransfer with the images, and the thus retransferred images are again transferred onto the surface of the product to be decorated. In the following, this image transfer mode will be set forth in detail.

Figure 27:
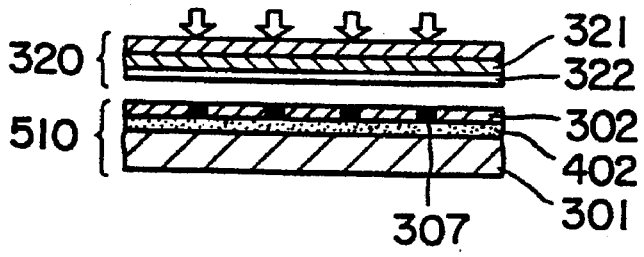
Figure 28:
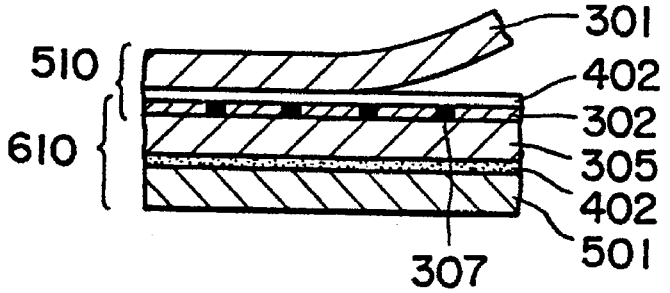
Figure 29:
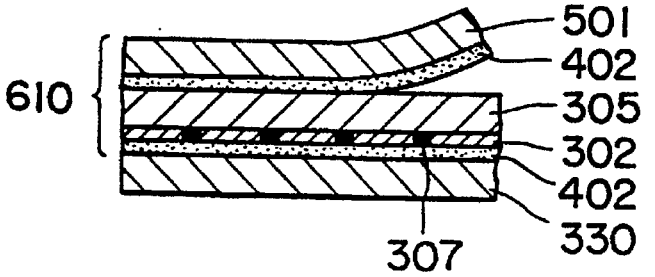

Embodiments shown in FIGS. 27, 28 and 29 represent such a process for execution of image transfer operation as by the intermediary of intermediate image transfer sheet 510. First, as shown in FIG. 27, a thermally image-transfer sheet 320 having a thermal transferable dyestuff layer 321 is overlapped to image-transfer sheet 510 which is, at this stage, not formed with images 307 and thus consists of a thermal image-transferable sheet, in such a way that .the dyestuff layer 321 or more specifically the parting layer 322 is in opposition to the image-reception layer 302 of the foregoing sheet 510. In such a case, however, that heat energy is supplied in accordance with image-forming signals delivered from the thermal head, not shown, and, indeed, preferably from the side of the sheet 320 as hinted by a plurality of doubleline arrows for thermal formation of desired images (positive images) as at 307 in the image-reception layer 302, it is highly recommendable to provide an adhesive layer 402 between the layer 302 and sheet-like substrate 301.

Then, with the use of the image transfer sheet 510 formed with positive images 307, the images of layer 302 are transferred, as shown in FIG. 28, to a separate intermediate substrate 501, which is, however, fitted with a protecting film layer 305, thus, the transfer being carried out, in fact, onto the latter, and indeed, with the correspondingly inverted images, attached with same reference numeral only for convenience, from the foregoing layer 302. In this case, it is preferable to subject the adhesive layer 402 of the image-transfer sheet 510 to the image-transfer operation, together with the image-reception layer 302. Further, as for the intermediate image-transfer substrate 501, it is recommendable to provide the protecting film layer 305 through the intermediary of a weak-adhesive layer 402' as shown. The thus provided intermediate image-transfer sheet 610 represents generally the image-transferable sheet.

FIG. 29 illustrates the step for transfer of the image-reception layer 302 now carrying positive images 307 onto the object 330 to be decorated and under utilization of the previously described intermediate image-transfer sheet 610.

More specifically, the intermediate image-transfer sheet 610 is overlapped onto the said object 330 in such a way that the adhesive layer 402 of the former in opposition to the surface of the object 330 and pressurized together. Then, the intermediate transfer substrate 501 together with the weak-adhesive layer 402' is peeled off from the remainder of the thus-pressurized assembly, the now image-carrying layer 302 formed with positive images 307 covered with protecting the film layer 305 thereby remaining in the transferred state on the product 330. In the case of no provision of the protecting film layer 305 on the intermediate image-transferable sheet 610, the layer 302 remains in an exposed state. Therefore, an overcoat layer, if necessary, can be provided on the now image-carrying layer 302.

The previously set forth process carried out by the use of said intermediate image-transferable sheet can be executed by means of the apparatus which is shown schematically in FIG. 1E.

In this apparatus, more specifically, there is provided a carrier system comprising a series of rolls 411, 412, 413 and 414 for conveying the intermediate transfer substrate (sheet), arranged in addition to the apparatus shown in FIG. 1B. More specifically, the substrate is drawn out from feed roll 414, conveyed through successive rolls 413; 412 and retransferred onto one of the products 200. Other operations are same as set forth hereinbefore with reference to FIG. 1B. Further, in the case of FIG. 1E, the final product may take the form of a roll-like substrate which is subjected to an image transfer operation through the intermediate substrate, by transferring its image-carrying, image-transferable layer, for later being punched out properly. Alternatively, under occasion, it may be subjected to half-cut operations downstream of roll 122.

As was set forth herein above, the preferable method for the formation of desired images on the image-transferable sheet is carried out by use of a heat image-transfer sheet comprising a sheet-like substrate having a layer including a thermally transferable dye (evaporative dye). The heat image-transfer sheet which can be utilized in this method is known per se. And almost every kind of these known sheets can be useful in the practice of the present invention. It should be noted that by employing the foregoing image-transfer method, mono-color or full-color images can be easily formed as occasion may desire.

It should be further noted that details of such heat image-transferable sheet can be easily understood with reference to our U.S. patent application Ser. No. 833039. As for the heat image-transferable sheet usable in the present invention, the coating layer of the sheet (coating film) may include a parting agent. By adopting this measure, the image-reception layer of the image-transferable sheet or the surface thereof, to be subjected to sublimative image-transfer, must not have a separate parting agent layer, the adhesive ability between the image-reception and the surface of object to be decorated can be still further improved upon execution of the sublimative image-transfer and image-formation at the image-reception layer and adherent attachment thereof to the object. As the parting agent to be included in the coating layer of the thermally image-transferable sheet (coating film), silicone oil; silicone resin; phosphoric ester or the like surfactant; and/or chelate- and the like agents, may be selectively utilized. These agents, upon mixed, will ooze out from inside to the outer surface of the coating layer, resulting in providing a better parting quality. However, it is preferable to properly select the kind and nature of the parting agent to be used for this purpose, being such that the agent cannot transfer to the image-reception layer of the image-transferable sheet during the sublimating image-transfer stage. The adding quantity of the parting agent may preferably be 3–25 wt. parts based upon the total amount of resin and coating composing the coating layer taken as 100 wt. %.

In practice, any kind of conventionally known heat transfer sheets is overlapped on the thermally image-transfer sheet employed in the present invention, and then necessary heat energy of 5–100 $mJ/mm^2$ is applied by use of a conventionally known heat transfer unit, for instance, "Video-printer: VY-100" manufactured and sold by Hitachi Seisakusho, Tokyo, or its equivalent machine, for the formation of necessary images on the image-reception layer of the image-transfer sheet as set forth hereinbefore.

Peel-off operation for removal of the image-reception layer formed with necessary images in the above manner may be carried into effect in a very easy manner, so as to provide it in a thin film carrying the images thereon. In case where the thus-peeled off film carrying the images is provided beforehand with an adhesive layer, composed of a suitable adhesive agent as was referred to, at the opposite surface to the image-carrying one, the peeled-off film can be, as it is, stuck on the object to be decorated. It is natural that this adhesive attachment procedure can be performed only partially and locally on selected part of the whole surface of the object, or totally thereon, as the case may be. On the contrary, if the peel-off film is provided beforehand with no adhesive layer, the film can be subjected occasionally to a heat fusion onto the surface of the object, if the physical properties or material kind thereof is suitable for such kind of thermal fusion. Or alternatively, a properly selected adhesive agent can be preparatorily applied onto the surface of the film or object, and then, the stick-on job can be executed.

If the image-reception layer is provided preparatorily with a parting layer thereon, as was referred to, the latter layer can be removed off partially or wholly, by grinding or rubbing operation after execution of the sublimating image-transfer job, for avoiding otherwise occurrence of ill effect by the very presence of parting layer in the adhesive attachment of the image-carrying layer film onto the decorative object.

In case of that where the image-transferable sheet is provided with a protecting layer and the latter is composed of a plastic resin film, this film may preferably be cut into pieces or subjected to punch-cuttings.

Figure 32:
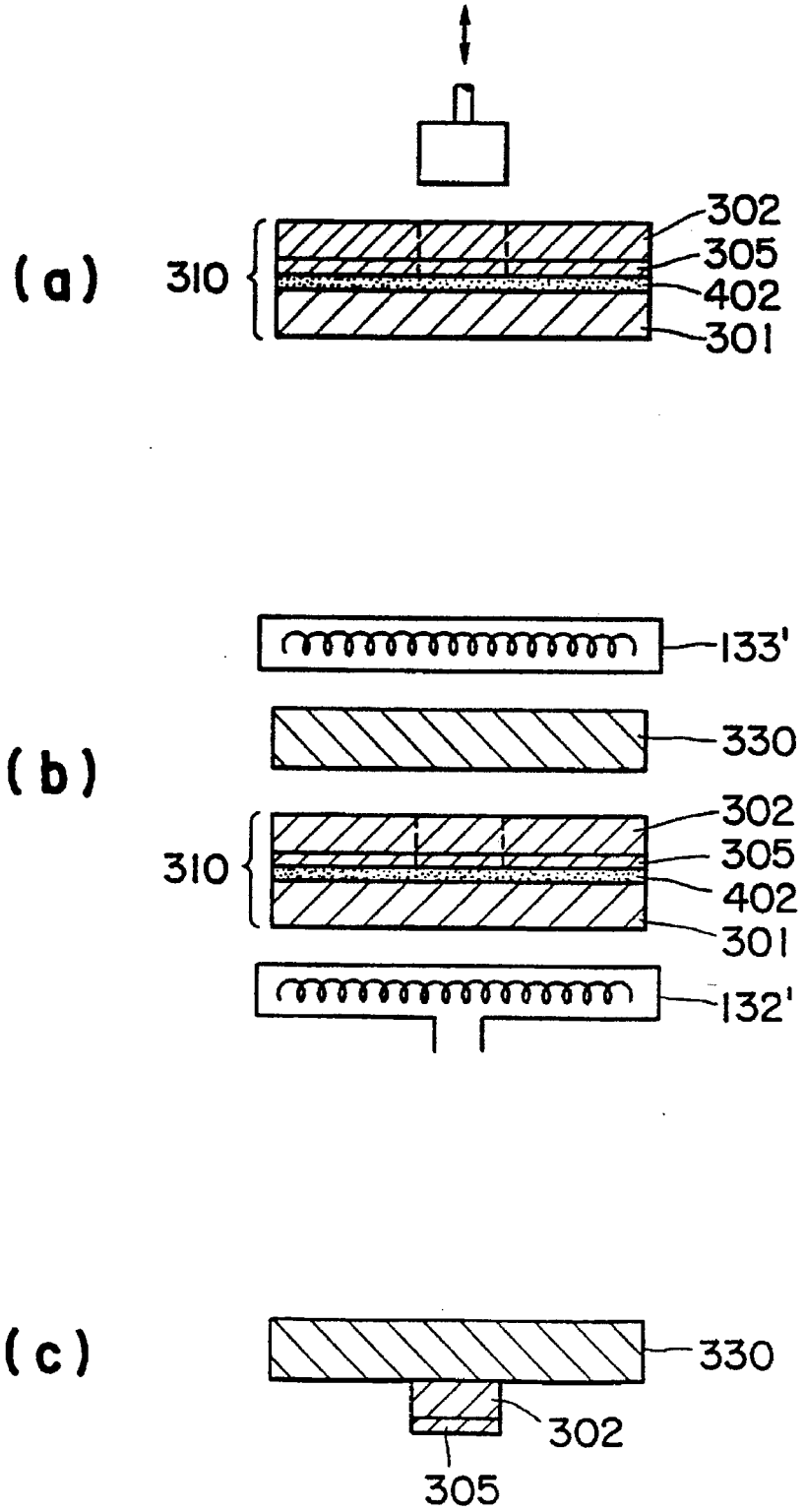
FIGS. 32 (*a*), (*b*), and (*c*) are sectional views, indicating final transfer steps.

FIG. 32 illustrates successive die-cutting steps in sectional views, serving for the above purpose. In this case, as shown in FIG. 32 at (a), only image-reception layer 305 of the image-transferable sheet 310, which has been image-formed through the way of the foregoing image-transfer step, are die-cut by operation of a cutter 801. Next, as shown in FIG. 32 at (b), a pair of hot stamps 132'; 133' are used to execute a pressurizing job under heat from opposite sides, thereby the decorative product 330 being processed into a final product provided tightly with an image-reception layer and a protecting layer, as shown in FIG. 32 at (c).

Further, when occasion desires, the image-carrying film is reversed up-and-down in position after execution of the peel-off job, and, the film is stuck onto the product to be decorated in such a state that the image-carrying surface of the film is kept in direct opposition to the product's decorating surface. In this case, however, it would be rather preferable that in advance of preparatory peel-off of the image-reception layer, the image-carrying transferable sheet is stuck onto the surface of the product to be decorated, and indeed, preferably with use of an adhesive agent, in such a way that the image-carrying layer is kept in direct opposition to the product surface and finally, the sheet-like substrate is peeled off, so as to leave the image-carrying surface on the product's surface.

As in the foregoing, when the images are once reversed and then stuck onto the object to be decorated, the forming images are preferable to reverse in mode (mirror-like relationship) the original to those of reversed mode.

It is further possible that the transfer or sticking-on of the image-carrying layer is carried out through the intermediary of a separate fusing sheet.

Figure 30:
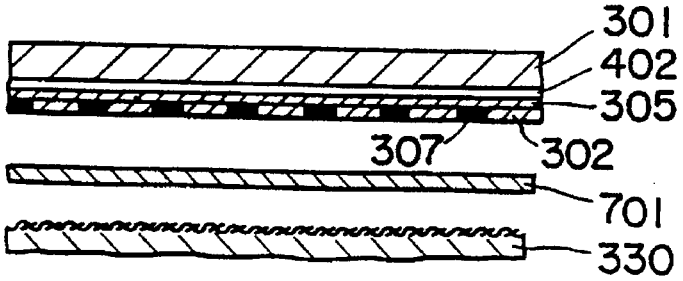
Figure 31:
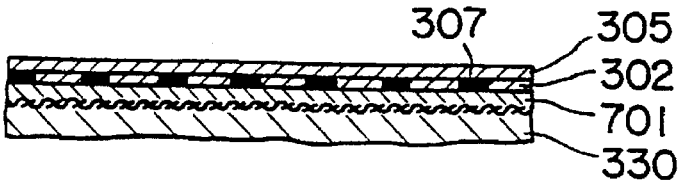

In FIG. 30, use of such fusing sheet 701 for reimage-transfer operation of image-carrying layer 2 already formed with necessary images 307, however, of reversed mode, and onto the surface of a product.

More specifically, the image-transferable sheet 310 is overlapped onto the product 330 to be decorated in such a way that the image-reception layer 302 carrying the necessary images 307 is kept in opposition to the surface of the product, and indeed, through the intermediary of a fusing seat 701 and then these three components are pressurized together. Further, sheet-like substrate 301, together with parting layer 303', is peeled off, thereby the image-reception layer 302, now having positive images 307 formed thereon, and protecting the latter, being transferred onto the product 330. It will be seen in this case, that there is no need for this transfer job, to provide in advance on adhesive layer on the surface of image-reception layer 302 and/or on the surface of the product 330, and further that a direct heat fusion onto the surface of the product 330 which may be composed of plastic resin, textile fabric, metal or the like common material, however, through the intermediary of a heat-fusible or heat-sealable sheet.

In case where the protecting layer 305 is of plastic resin, similar composing technique as mentioned above may be employed by substituting a weak-sticking layer 402' for parting layer 303'.

As the heat-fusible or heat-sealable sheet as at 701 employable in the present invention, it may be composed of one or other material capable of adhering under heat, pressure or both, especially suitable one of those which become soft to be adhesive upon heating. These heat adhering materials in the form of sheets will be, upon softening, charge the pores, meshes or stitches of the product material composed preferably of textiles, woven or non-woven; knits, rough-surface papers or meshed materials, thereby the surface of the product becoming highly smooth for well receiving the image-reception layer 302 for desired image-retransfer with trouble, which effect is superior in the art.

On the contrary, when such heat-fusible or heat adhesive sheet materials which may be called "heat bond sheets" as at 701 are not utilized, it is highly difficult to realize the image-retransfer operation onto certain kind of objects such as rough-surfaced or rough-meshed fabric or the like. Even if the retransfer job could be executed, the obtained images may be blurred and the adhesive may be insufficient, on account of the very thin thickness of the image-reception layer 302, thus giving rise to technical and commercial troubles.

As for the heat fusible sheet 701 to be used in the foregoing manner, ethylene/vinyl acetate copolymer, nylon copolymer; epoxy/phenol copolymer; epoxy/vinyl copolymer; acrylic resin; polyester resin; or polyolefin resin and the like thermoplastic resins (heat sensible adhesive agents) which are formed into sheets or films may be used. These materials must be softened at 100°–250° C. or so to represent viscous adhesive characteristics. These materials are, when used, capable of being stuck to both the image-transferred product 330 and the image-carrying layer 302.

These heat bond sheets 701 have generally thickness of 1–200 μm. When the surface of the product 330 to be decorated is relatively smooth, the sheet selected out may be of relatively thin thickness, while, on the contrary, when the surface of the decorative product 330 is relatively rough, as in the case of textile fabrics, unwoven fabrics, meshed fabrics or the like, use of thicker heat bond sheets is rather recommendable.

As set forth above, the use of heat bond sheets is highly recommendable in the decorative image-transfer onto rough surface products, such as those of rough fabrics, woven or non-woven, knitted clothes, meshed one or the like, thereby a better quality image-transfer being executed, in spite of the meshed or highly undulating surface conditions of the objects to be decorated.

Further in the present invention, during the adhering attachment of the image-reception layer already formed with necessary images onto the object or product, an additional processing step is preferably introduced for prevention of occasional interference in the foregoing adhering attachment step, by rubbing-off or grinding-off part or whole of the parting layer, provided on the surface of the now image-carrying layer, upon completion of the sublimating image-transfer step.

Still further, in such a case that the image-transferable sheet is fitted with a protecting layer which is composed of a plastic resin film, the latter must in advance be subjected to punching or the like cutting step for cutting the film into desirously sized pieces.

FIG. 32 represents such a die-cut (half-cut) process in sectional schema. In this case, at first, as shown at (a) of FIG. 32, the image-reception layer 302 of an image-transferable sheet 310, now formed with necessary images through a sublimative image-transfer step, and the protecting layer 305, are subjected to a die-cutting process by means of a cutter 801 to shape a desired shape. And then, as shown at (b) in FIG. 32, the cut-out piece is subjected to a pressurizing step under heat by means of a pair of hot stamps 132'; 133' to provide a final decorative object, as shown at (c) in FIG. 32, which is composed of a product 330 to be decorated, however, now attached integrally and jointly with image-carrying layer 302 and protecting layer 305.

Applied Products

The products applicable with the inventive process for decorating purposes are not limited to occasionally employed kind, shape and nature of the materials. Preferred examples of the usable product may be: cartons; vessels or packages; bags; cassette cases; cassette halves; floppy cases; paper packages and envelopes; stock certificates; personal and bank cheques; bills; bonds; certificates; notifications; car tickets; travel tickets; betting tickets; tax stamps; postage stamps; entrance tickets, money-exchangeable papers and documents; cash-cards, credit cards, orange cards, telephone cards; member's cards; greeting cards; postcards, name cards; driver's certificates; IC-cards; optical cards and the like various cards; accounting cards and documents-envelopes; tags; OHP-sheets; slide films; bookmark slips; calendars; posters; pamphlets; menus; passports; POP-goods and articles; coasters; displays; nameplates; keyboards; cosmetics; personal ornaments (watches; cigarette lighters); stationaries; construction materials; radio-receiving sets; T.V.-sets; speakers; table calculators; automotive gauge boards; emblems; keys; clothes; wearing commodities; footwears; appliances; CA-instruments; sample books; tickets in general; albums; computer graphic and/or medicare graphic image printouts; and the like, where the material kinds, sizes and configurations are regardless for purposes of the invention.

The aforementioned goods and instruments may have printed or the like other images in advance of execution of the process of the invention. Or conversely, the goods and instruments can be formed with necessary images in accordance with the present process, and then, additional images may be formed in conventional printing or the like process.

As an example, when the invention is applied to a card style intermediate product, it is possible to combine image-forming means of the present invention with conventional recording means. As the latter, magnetic recording by use of a magnetic material layer; optical recording by use of an optical recording layer; preferably composed of a membrane having low melting point metal; application of hologram; embossing formation of characters and numerals; application of personal face photograph; engraved formation of personal face or the like; human signatures; recorded information with use of IC-memory; mechanical printing; formation of bar codes; formation of characters and patterns by use of printer, typewriter or pen plotter may be used independently or in any combination.

In the following, the present invention will be more fully described by way of preferred embodiments. In these embodiments, parts or % will be given by weight, not otherwise specifically referred to.

As the image transfer film (dye film) used for sublimating transfer onto the image-transferable sheets, a polyester film, 6 μm thick, subjected to a heat-resisting treatment on one surface thereof only, and bearing color ink composition areas of yellow, magenta and cyan, respectively, was used. The coating rate of the color ink composition was 1.0 g/m$^2$ when measuring at the dry state.

These color ink compositions were as follows.

| Yellow ink composition | |
|---|---|
| polyvinyl butyral resin ("Eslek-BX-l", manufactured and sold by Sekisui Kagaku K. K., Tokyo) | 4.80 parts |
| dispersion dye ("PTY-52, Disperse Yellow-141", manufactured and sold by Mitsubishi Kasei Kogyo Co., Ltd., Tokyo) | 5.50 parts; |
| methyl ethyl ketone | 55.00 parts; |
| toluene | 34.70 parts; |
| (parting agent | 1.03 parts) |

| Magenta ink composition | |
|---|---|
| polyvinyl butyral resin (same as above in the case of yellow color ink) | 3.92 parts; |
| dispersion dye ("MS Red G, disperse red 60", manufactured and sold by Mitsui Toatsu K. K.) | 2.60 parts; |
| dispersion dye ("Macrolex Red Violet R, Disperse Violet 26", manufactured and sold by Beyer A. G., West Germany) | 1.40 parts; |
| methyl ethyl ketone | 43.34 parts; |
| toluene | 43.34 parts; |
| (parting agent | 0.40 part) |

| Cyan color ink composition | |
|---|---|
| polyvinyl butyral resin (same as in said yellow color ink composition) | 3.92 parts; |
| dispersion dye ("Kayaset Blue-714, solvent blue-63", manufactured and sold by Nippon Kayaku K. K., Tokyo) | 5.50 parts; |
| methyl ethyl ketone | 68.18 parts; |
| (parting agent | 0.94 parts) |

Each of the foregoing color ink compositions was prepared with and without addition of parting agent.

As the parting agent occasionally used in each of the foregoing color ink compositions, any of the following specific agents may be employed:

(a) silicone alkyd parting agent, "KR-5206", manufactured and sold by Shinetsu Kagaku Kogyo K.K., Tokyo;

(b) graft polymer of silicone and acryl, "GS-30", manufactured and sold by Toa Gosei Kagaku K.K.;

(c) silicone graft polymer, "US-3000", manufactured and sold by the above company;

(d) phosphoric acid ester, natrium salt, "RE-410", manufactured and sold by Toho Kagaku Kogyo K.K.;

(e) natural phosphoric acid ester, "Lecytin", manufactured and sold by Ajinomoto Co., Ltd., Tokyo;

(f) silicone oil, "KF 412", manufactured and sold by Shinetsu Kagaku Kogyo K.K., Tokyo;

(g) aluminum chelate agent, "ALM", manufactured and sold by Ajinomoto; and (h) titanium chelate agent, "TTS", manufactured and sold by Nippon Soda K.K., Tokyo.

Example A-1

As the substrate, a laminate of a synthetic paper, "Yupo FPG 150 μm thick" manufactured and sold by Oji Yuka Co., Ltd., Tokyo, and a polyester film, 6 μm thick, was prepared and coated on the polyester film side surface by a wire bar with a mixture of pull-separating varnish, "Hakurinisu 45" manufactured and sold by Showa Ink Co., Ltd., Tokyo, with an ultra-violet absorbing agent, or more specifically, 2.5-bis (5'-tert-butylbenzoxazolyl (2))-thiofin, 0.5% based on the resin content of the varnish, and dried up to provide a protecting layer of 1 g/m$^2$, when weighed upon drying.

Then, on the surface of the foregoing protecting layer, an ink composition adapted for the formation of an image-reception layer was coatingly applied and dried up. The applied quantity amounted to 7 g/m$^2$ when measured upon drying.

| Ink composition for the formation of image-reception layer | |
|---|---|
| polyester resin (manufactured and sold by Toyobo K. K.) | 100 parts; |
| amino-modified silicone ("KF-393", manufactured and sold by Shinetsu Kagaku Kogyo K. K., Tokyo) | 5 parts; |
| epoxy-modified silicone ("X-22-343", manufactured and sold by Shinetsu Kagaku Kogyo) | 5 parts; |
| solvent (methyl ethyl ketone/toluene/cyclohexanon 4/2/2) | 900 parts. |

The ink composition was coated, dried up and cured one day under normal temperature. Then, the layer was kept at 100° C. for 30 minutes under heat, for letting the silicone to bleed up to the surface, to provide an image-transferable layer formed on its surface with a hardened silicone layer.

On the thus-provided image-reception layer, a sublimating image-transfer film was overlapped which is composed of cyan color sublimative dye (molecular weight being higher than 250) carried by a proper binder resin and thermal energy is fed thereon from a thermal head adapted for receiving electric signals representing cyan color components obtained by a color analysis of a portrait photograph, as an example, for providing portrait images corresponding thereto. Then, two successive sublimative image-transfer jobs were executed with use of respective sublimating image-transfer films carrying sublimative magenta and yellow color dyes, each molecular weight being higher than 250, and substantially in the manner set forth above. In this way, after all, an overall combined display image composed of a full color portrait, in combination with several characters and graphics, was provided.

The image-reception layer of the sheet, now carrying these display images, was overlapped on the card substrate composed of a polyester resin sheet, 100 μm thick, which had been primed to white-opaque state, and pressurized together at 160° C. by means of heated pressure rolls. Then, the polyester film was peeled off at the interface with the protecting layer, thereby providing a final product card transferrd with image-reception layer now carrying the desired image display.

It was found that the overall surface of the product card was generally smooth and showing no raised feeling of the thus-formed and displaying images. Even upon an accelerated testing of the product card for three months held in an atmosphere of 40° C., the images showed no blurrings as well as no interlayer separation. Further, according to an accelerated light-proof test carried out as prescribed in JIS-Standard with use of a carbon arc lamp, the results showed to be classified to JIS-4 or -5 corresponding to an acceptable superior performance. Additionally, a surface scratch test and the like showed also superior durability.

Example A-2

The foregoing image-transferable sheet, now image-carrying, as processed in Example A-1, is then subjected to a peel-off operation for separating the image-carrying layer from the sheet. Then, an adhesive agent of polyester series was coated on the exposed surface of the peeled-off film, and stuck under pressure on a curved surface part of a telephone set. The images could follow up to the stuck curvature into a unitary solid mass, and indeed, without inviting any stuck-on feeling, contrary to the case when a sticky loose-leaf stamp should have been stuck on. In this way, miracle viewing feelings as obtainable with direct-printing operation only, were created and maintained.

Example A-3

A white polyester film, baked on one surface thereof with melamine coating, "E 20", 100 μm thick, manufactured and sold by Toray Co., Ltd. Tokyo, is formed on the opposite surface with a slipping layer, same as in the following Example C-2, through application of polyurethane primer. And an identification mark was provided thereon through the way of regular printing technique. On the melamine resin-baked surface of the white polyester resin film, a layer of peeling varnish (of polymethyl methacrylate-series); manufactured and sold by Showa Inku. Co., Ltd., Tokyo) was applied in dry quantity of 2 g/m$^2$ and dried up to provide a definite layer.

On the thus-formed protecting layer, the following image-reception layer-forming composition was coated and dried up, so as to form an image-heat transferable sheet. The coated composition was in quantity of 6 g/m$^2$ by dry weight.

| Image-reception layer-forming composition | |
|---|---|
| polyester resin ("Vylon 600", Tg: 47° C., manufactured and sold by Toyobo, Osaka) | 80 parts; |
| polyester resin ("Vylon 290", Tg: 77° C., manufactured and sold by Toyobo) | 20 parts; |
| amino-modified silicone ("KF-393", manufactured and sold by Shinetsu Kagaku Kogyo) | 7 parts; |
| epoxy-modified silicone ("X-22-343", manufactured and sold by Shinetsu Kagaku Kogyo) | 7 parts; |
| solvent (methyl ethyl ketone/toluene = 1/1) | 800 parts. |

On the image-reception layer of the foregoing heat image-transferable sheet, reversed images composed of full color portrait images together with characters and graphics by use of a thermal head, as in the same way with Example A-1, were formed.

Next, the image-reception layer, however, now carrying the reversed images formed in the foregoing manner was brought into contacting and overlapping state with the image displayable surface on a card style substrate made of white color polyester resin, 125 μm thick, preparatorily primer treated as before, and pressurized together under the action of thermal rolls, and the white polyester film, 100 μm, was peeled off between the protecting layer and the melamine-baked layer, thus providing a final card-style product transferred with the image-reception layer now carrying the necessary images.

The surface of the final card style product represented a smooth and slippery, without fear of interlayer separation and with superior light resistant power.

Example A-4

A white foam polyester resin film, "Merinex", 125 μm thick, manufactured and sold by ICI, was provided with an identification mark on one surface thereof, with regular printing technique.

Then, on the opposite surface of the white foam polyester resin film to the foregoing surface formed with the identification mark, a coating of a polyurethane-series primer was applied and dried up. Further, the following protecting layer-forming composition was applied in dry quantity of 3 g/m$^2$ and dried up to form a protecting layer.

| Protecting layer-forming composition | |
|---|---|
| acrylic polyole ("Acrit 6416MA", manufactured and sold by Taisei Kako K. K.) | 41 parts; |
| toluene | 36 parts; |
| methyl ethyl ketone | 27 parts; |
| diisocyanate ("Colonate", manufactured and sold by Nippon Polyurethane K. K.) | 6 parts. |

On the above protecting layer, the following composition was applied in dry quantity of 3 g/m$^2$ and dried up, to provide an intermediate layer.

| Intermediate layer-forming composition | |
|---|---|
| polyester resin ("Vylon 290", manufactured and sold by Toyo Boseki (Toyobo) K. K., Osaka) | 15 parts; |
| toluene/methyl ethyl ketone = 1/1 | 85 parts. |

On the thus-formed intermediate layer, an image-reception layer which is substantially same with that in the foregoing Example A-3 was provided, so as to form an image-transferable sheet. Then, as same in the foregoing Example A-3, correspondingly inverted images were formed on the image-reception layer and further then, subjected to transfer onto the card substrate by use of thermal rollers. In this way, a final product card, having an image transferable, yet now image-formed layer, was provided.

This card showed favorable results of light-resisting test. Further, it showed a better scratch test result than the foregoing card obtained in Example A-3.

Example A-5

Substrate

A white polyester film, "E-20", 100 μm thick, manufactured and sold by Toray Co., Ltd., Tokyo, was used.

| Intermediate layer-forming composition | |
|---|---|
| Polyester resin ("Vylon 600", manufactured and sold by Toyo Boseki K. K., Osaka) | 15 parts; |
| toluene/methyl ethyl ketone = 1/1 (dry weight: 5 g/m$^2$) | 85 parts. |

| Protecting layer-forming composition | |
|---|---|
| "Hakuri-Nisu" (acrylic resin varnish, manufactured and sold by Showa Ink K. K.) (dry weight) | 2 g/m$^2$ |

| Image-reception layer-forming composition | |
|---|---|
| polyester resin ("Vylon 600", manufactured and sold by Toyo Boseki K. K., Osaka) | 10 parts; |
| polyester resin ("Vylon 200", supplied by Toyo Boseki K. K.) | 5 parts; |
| toluene/methyl ethyl ketone = 1/1 | 85 parts; |
| amino-modified silicone ("KF-393", manufactured and sold by Shinetsu Kagaku Kogyo) | 1 part; |
| epoxy-modified silicone ("X-22-343", supplied by Shinetsu Kagaku Kogyo) | 1 part. |
| (coated quantity (dry) | 5 g/m$^2$) |

With use of the foregoing composition and processed in similar way as in Example A-3, to provide a final card product, having an image-reception layer transferred with necessary images.

Example A-6

Substrate

White polyester resin film, "E-20", 100 μm thick, manufactured and sold by Toray was coated with polyurethane-series primer and dried up.

| Parting layer-forming composition | |
|---|---|
| melamine resin ("Meran 45", manufactured and sold by Hitachi Kasei) | 100 parts; |
| hardener (para-toluenesulfonic acid) | 20 parts; |
| (coating quantity (dry), 2 g/m$^2$) | |

| Protecting layer-forming composition | |
|---|---|
| vinylchloride-vinylacetate ("Vinylite VYHH", manufactured and sold by Union Carbide Corp.) | 15 parts; |
| methyl ethyl ketone = 2/1 | 85 parts; |
| (coating quantity (dry): 2 g/m$^2$) | |

| Intermediate layer-forming composition | |
|---|---|
| polyurethane resin ("Takelac T-3350", manufactured and sold by Takeda Pharmaceutical Company, Osaka, of 23%-concentration) | 50 parts; |
| isopropyl alcohol | 15 parts; |
| toluene | 25 parts; |
| methyl ethyl ketone | 10 parts. |
| (coating quantity (dry) 5 g/m$^2$) | |

| Image-reception layer composition | |
|---|---|
| polystyrene resin ("Picolastic D125" (Tg = 53° C.), manufactured and sold by Hercules | 15 parts; |
| toluene/methyl ethyl ketone = 1/1 | 85 parts; |
| amino-modified silicone ("KF-393", manufactured and sold by Shinetsu Kagaku) | 1 part; |
| epoxy-modified silicone ("X-22-343", manufactured and sold by Shinetsu Kagaku) | 1 part. |
| (coating quantity (dry): 6 g/m$^2$) | |

The foregoing composition was prepared and used as in the same manner with Example A-3, to provide a card with the image-reception layer subjected to image-transfer as desired.

Example B-1

As the substrate, a polyester resin film, 6 μm thick, was used and a polyester resin-series primer was coated on one surface thereof and dried up. Further, the following ink composition was applied and dried up. The coating quantity of the composition was set to about 7 g/m$^2$.

| Image-reception layer-forming composition | |
|---|---|
| polyester resin ("Vylon 200", manufactured and sold by Toyo Boseki K. K.) | 100 parts; |
| amino-modified silicone ("KF-393", manufactured and sold by Shinetsu Kagaku) | 5 parts; |
| epoxy-modified silicone ("X-22-343", manufactured and sold by Shinetsu Kagaku) | 5 parts; |
| solvent (methyl ethyl ketone/toluene/cyclohexanone = 4/2/2) | 900 parts. |

The ink composition was coated, dried up and left standing for a full day, and then subjected to heat treatment at 100° C. for 30 minutes, so as to bleed the silicone towards the film surface for providing thereon an acceptable image-reception layer composing the active surface.

Then, a sublimative image-transferable film, composed of a resin binder evenly mixed with a proper amount of sublimative cyanic dye, the molecular weight being higher than 250, was overlapped on the above image-reception layer and applied with heat energy by means of a thermal head supplied with electric signals corresponding to cyanic color components of a portrait full color photograph as determined by regular color analysis, thus providing cyanic color component images.

Next, as for magenta and yellow color components, similar respective processings were executed and finally, full color display portrait images could be formed.

Then, the exposed surface of image-reception layer of the thus-display image-formed film was overlapped on a card substrate composed of a white opaque, hard vinyl chloride resin sheet, 100 μm thick and pretreated with a conventional primer, and then this assembly was subjected to heat and pressure by means of a pair of heated rolls. In this way, a card product stuck with an image-transferable and now carrying layer was provided.

The surface of this card was generally smooth and slippy, the thus-formed images thereon providing no raised feelings. In an accelerated test of these formed images in hot atmosphere of 40° C. for a continuous period of three months, there were no appreciable image blurring and interlayer separation. Upon execution of a light exposure test in accordance with prescribed conditions in JIS with use of an arc lamp, the results were classified to JIS-4 to 5 Classes which means as acceptable and better image quality. Scratch test results were also superior.

Example B-3

A sticking layer, 1 μm thick, was formed with a polyamide resin sticking agent on the image-carrying surface of the image-transferable sheet, image-formed in the manner as described in foregoing Example B-1, and the thus provided sheet was stuck on the curved surface of a glass tumbler. These images express practically no stuck-on feelings, rather providing such a touch and viewing feeling as if they had been formed by the regular and direct printing technique.

Example C-1

With use of the image-transferable sheet prepared in the foregoing Example A-1, images were formed substantially in accordance with procedures mentioned therein, however, with exception of the formation of reversed images, and then, the image-carrying layer was, without execution of the foregoing peel-off operation, stuck on a portion of curved outer surface of a glass tumbler, whereupon the sheet-like substrate was peeled off, together with the weak-sticking layer. The thus-applied images represent almost no sticking-on grip and viewing feeling, as if they should have been applied through regular and direct-printing technique.

Example C-2

On the surface of a transparent polyester film, 12 μm thick, employed as a protecting film, the following image-reception layer forming composition was applied to form a coated layer (in quantity of 6 g/m$^2$ when measuring upon drying), dried up and left as it was for full one day. Then, it was held at 100° C. for 30 minutes, to form an image-reception layer. On the surface thereof, a parting surface layer was found to exist, which was composed of a combined hardened product of amino-modified silicone resin and epoxy-modified silicone resin.

| Image-reception layer-forming composition | |
|---|---|
| polyester resin ("Vylon 600", manufactured and sold by Toyo Boseki) | 100 parts; |
| amino-modified silicone resin ("KF-393", manufactured and sold by Shinetsu) | 7 parts; |
| epoxy-modified silicone resin ("X-22-343", manufactured and sold by Shinetsu) | 5 parts; |
| solvent (methyl ethyl ketone/toluene = 1/1) | 800 parts. |

As the substrate, on the other hand, white polyester resin film, "E-20", 75 μm, manufactured and sold by Toray, was used and coated on one surface thereof with a polyurethane-series primer and dried up. Then, the following composition (in the dried quantity of 1 g/m$^2$) and dried up, so as to provide a smooth and stick layer.

| Smooth layer-forming composition | |
|---|---|
| polymethyl methacrylate resin ("Dianal BR-85", manufactured and sold by Mitsubishi Rayon Co., Ltd., Tokyo | 12 parts; |
| polyethylene wax ("MF8F", manufactured and sold by Dulacon Co.) | 0.5 part; |
| toluene/methyl ethyl ketone = 1/1 | 85 parts. |

On the opposite surface of the white-polyester resin sheet to the smoothed surface there, a primer coating of polyurethane-series is applied and dried up, and further coated thereon with the following composition, in quantity of 3 g/m$^2$, so as to provide a weak-sticky layer.

| Weak-sticky layer-forming composition | |
|---|---|
| weak-sticky adhering agent ("Esdyme AE-206", manufactured and sold by Sekisui Kagaku Kogyo K. K., Tokyo) | 50 parts; |
| water | 50 parts. |

The weak-sticky adhering layer is brought into contact with the protecting film consisting of a polyester film, 12 μm thick, at the opposite surface to the image-reception layer, and then subjected to heat and pressure, to provide an image-transferable sheet. Upon bringing the image-reception layer of the image-transferable sheet and the dyestuff layer of the heat-image transfer sheet into contact with each other, heat energy was applied from a thermal head, as in the similar manner mentioned in the foregoing Example A-1, and thus heat image-transfer job was executed, so as to provide reversed mode images for expressing a full color portrait as well as characters and graphics.

Next, the image-reception layer formed with the reversed images thereon was overlapped onto the image-displayable surface of a card style substrate, 100 μm thick, made of a white color polyester resin material preparatorily applied with a primer layer by coating a composition, consisting of "Vylon 200", 100 μm thick, manufactured and sold by Toyo Boseki K.K., and then subjected together to heat and pressure by means of at least a heated roll at 160° C. Then, the white polyester film, 75 μm thick, and the weak-sticky adhesive layer were peeled off in unison, for providing a final decorative product card having the image-reception layer transferred with images and carrying dislay images.

This card had a highly smooth surface and was not liable to invite any interlayer separation and showed superior light fastness.

In place of white color polyester-made card substrate preparatorily formed with a primer layer, such a modification was prepared and experimented that the white polyester sheet was formed on its rear surface with a magnetic layer, while, on its front surface there is formed with a write-on layer which consists of proper filler and resin as conventionally, so as to provide a telephone card. This processed telephone card had the write-on layer provided with display images formed by image-transfer.

Example C-3

On the surface of a transparent polyester film, 9 μm thick, used as the protecting layer, an intermediate layer was provided by coating. The coated amount was 5 g/m$^2$ as measured upon being dried up.

| Intermediate layer-forming composition | |
|---|---|
| polyurethane resin ("Takelack T-3350", solid content 23%, manufactured and sold by Takeda Pharmaceutical Co., Ltd., Osaka) | 50 parts; |
| isopropyl alcohol | 15 parts; |
| toluene | 25 parts; |
| methyl ethyl ketone | 10 parts. |

Onto the intermediate layer, the following composition was applied for the formation of an image-reception layer. The coated quantity was 5 g/m$^2$ as measured upon being dried up.

| Image-reception layer-forming composition | |
|---|---|
| polyester resin ("Vylon 600", manufactured and sold by Toyo Boseki) | 10 parts; |
| polyester resin ("Vylon 200", manufactured and sold by Toyo Boseki) | 5 parts; |
| amino-modified silicone ("KF-393", manufactured and sold by Shinetsu) | 1 part; |
| epoxy-modified silicone ("X-22-343", manufactured and sold by Shinetsu) | 1 part; |
| solvent (methyl ethyl ketone/toluene = 1/1) | 85 parts. |

On the other hand, a white color polyester film, which was similar to that employed in the foregoing Example C-2 was formed with a slidingly smooth layer, as well as a weak-sticking adhesive layer, the latter being brought into intimate contact with a transparent polyester film, 9 μm thick, at the opposite surface to the image-reception layer and then, subjected to heat and pressure, for providing a heat image-transferable sheet. As further processed in the similar manner in the foregoing Example C-2, full-color photographic images (reversed images) were thus formed on the image-reception surface. In this way, a final product card, having its image-reception layer transferringly formed with display images.

Example C-4

Substrate

White color polyester sheet, "E-20", 100 μm thick, manufactured and sold by Toray was formed thereon with a polyurethane-series primer coating. Then, a weak-sticking layer was applied thereon with use of the following composition.

| Weak-sticking layer-forming composition | |
|---|---|
| weak-sticking agent ("Esdyne AE-206", manufactured and sold by Sekisui Kagaku Kogyo K. K., Tokyo) | 50 parts; |
| water | 50 parts. |

| Protecting layer-forming composition | |
|---|---|
| polyester resin ("Vylon-200", manufactured and sold by Toyo Boseki) | 15 parts; |
| diisocyanate ("Colonate L", manufactured and sold by Nippon Polyurethane Co., Ltd.) | 1 part; |
| toluene/methyl ethyl ketone = 1/1 | 84 parts. |

| Image-reception layer-forming composition | |
|---|---|
| polyester resin ("Vylon 600", manufactured and sold by Toyo Boseki K. K.) | 10 parts; |
| vinyl chloride-vinyl acetate copolymer resin ("Vinylite VAGH" (Tg = 79° C.), manufactured and sold by Union Carbide Corp) | 5 parts; |
| toluene/methyl ethyl ketone = 1/1 | 85 parts; |
| amino-modified silicone ("KF-393", manufactured and sold by Shinetsu) | 1 part; |
| epoxy-modified silicone ("X-22-343", manufactured and sold by Shinetsu) | 1 part. |

With use of the above composition and processed substantially same as in the foregoing Example C-2, a final card product was obtained.

Example D-1

An image-transferable sheet was prepared as in the foregoing Example A-1 and thermally image-transferred with reversed mode images of a full color portrait photograph, to provide an intermediate image-transfer medium. The latter is overlapped by its image-reception layer onto the surface of a sheet of rough-textured cotton cloth, however, through the intermediary of an acrylic acid ester-vinyl acetate copolymer sheet, 100 μm thick. Then, the assembly was subjected to heat and pressure. Then, the substrate sheet and weak-sticky adhesive layer, together, were peeled off. The thus transfered images have sufficient surface smoothness, showing superior surface conditions.

Without use of the bond-attaching sheet in the above process and when similar image-transfer job as above was performed, the resulted images followed the surface undulations appearing disadvantageously on the material product of the rough fabrics and thus were highly uneven, and further, on account of insufficient adhering performance acting between the image-receiving layer and the woven fabrics serving as product material, easy and frequent separations took place therebetween.

Example D-2

In the similar way as was disclosed in the foregoing Example D-1, an intermediate image-transfer medium carrying reversed images was prepared and overlapped on a polymethacrylate board preparatorily subjected to surface-roughening operation through a conventional sand-blasting step, and through the intermediary of a bond-adhering sheet pressurized together under heat, as was employed in Example D-1. Then, the sheet-like substrate was peeled off, together with the weak adhesive layer. The thus-provided images were highly smooth and even in spite of the highly rough and undulating conditions at the surface to be image-transferred. In addition, the image-carrying surface showed superior results in various resisting tests.

Without use of the foregoing bond-sticking layer, the similarly transferred images showed considerable undulations and distortions. Further, on account of insufficient adhering performance, easy and frequent peel-offs of applied images were feared.

Example D-3

On the surface of a polyester resin film, 25 μm thick, the following composition adapted for the formation of bond-sticking layer was coated and dried up, in dried quantity of 5 g/m$^2$, to provide a film formed thereon a bond sticking sheet.

| Bond-sticking sheet-forming composition | |
|---|---|
| polyester resin ("Vylon 600", manufactured and sold by Toyo Boseki) | 15 parts; |
| methyl ethyl ketone/toluene = 1/1 | 84 parts. |

The bond-sticking sheet surface, together the polyester resin film proper, was brought into contact with the image-representing surface of a white color polyester made-card substrate, 25 μm thick, and then, subjected to heat and pressure by means of at least a heat roll kept at 200° C., arranged to supply heat energy from the side of the polyester resin surface, thereby heat bonding the bond-sticking sheet onto the card surface, whereupon the polyester resin film being forcedly peeled off.

Further then, as in the similar way as adopted in foregoing Examples C-2; A-3; A-4 and C-3, use is made of the image-reception layers representing reversed images thereon, the respective image-reception layers were whereupon brought into contact with the card's bond-sticking surface of the card and subjected to heat and pressure by use of at least a heat roll kept at 200° C. Then, the white color polyester resin substrate was peeled off, together with the weak-sticky adhering layer. In this way, a final product card displaying the portrait photograph was obtained.

Example D-4

Substrate

A white color polyester resin sheet, "E-20" 100 μm thick, manufactured and sold by Toray Co. Ltd., was coated with a polyurethane-series primer. On the surface of the thus precoated sheet, the following composition was coated to form a weak-sticking adhesive layer.

| Weak-sticking adhesive component | |
|---|---|
| weak-sticking adhesive agent, ("Esdyne AE-206", manufactured and sold by Sekisui Kagaku) | 50 parts. |

| Image-reception layer-forming composition | |
|---|---|
| polyester resin ("Vylon 200", manufactured and sold by Toyo Boseki) | 7.5 parts; |
| polyester resin ("Vylon 290", manufactured and sold by Toyo Boseki) | 7.5 parts; |
| toluene/methyl ketone = 1/1 | 85 parts; |
| amino-modified silicone ("KF-393", manufactured and sold by Shinetsu) | 1 part; |
| epoxy-modified silicone ("X-22-343", manufactured and sold by Shinetsu) | 1 part. |

The foregoing compositions were prepared. On the other hand, a polyester resin film, 25 μm thick, was coated on one surface thereof with a 15%-solution of polyester resin, "Vylon 200", manufactured and sold by Toyo Boseki, in toluene/methyl ethyl ketone=1/1 and dried up. The coating quantity was adjusted to 5 g/m$^2$ when measuring in dried state. In this way, a bond-sticking sheet was provided.

Then, the coated surface of the thus prepared bond-sticking sheet was brought into contact with the image display surface of a card style substrate of white color hard vinyl chloride or the like resin material preparatorily subjected to a primer coating treatment in overlapping state and then, the whole assembly was subjected to heat and pressure with use of at least a heated roll to 130° C., thus the bond-sticking layer being stuck on the card surface. Under this condition, the polyester resin film, 25 μm thick, was peeled off.

Then, the image-reception layer, now carrying thereon reversed images, was brought into contact with the bond-sticking sheet and the resulted whole was subjected to heat and pressure by use of at least a heated roll and the white color polyester resin substrate, together with the weak-sticking adhesive layer, was peeled off. In this way, the card, now displaying the portrait images, was provided.

Example D-5

Substrate

Same as in the foregoing Example D-4.

Weak-sticking adhesive layer

Same as in the foregoing Example D-4.

| Protecting layer-forming composition | |
|---|---|
| polyester resin ("Vylon 200", manufactured and sold by Toyo Boseki) | 15 parts; |
| diisocyanate ("Colonate L", manufactured and sold by Nippon Polyurethane) | 1 part; |
| toluene/methyl ethyl ketone = 1/1 | 84 parts. |

| Image-reception layer-forming composition | |
|---|---|
| polyester resin ("Vylon 600", manufactured and sold by Toyo Boseki) | 10 parts; |
| toluene/methyl ethyl ketone = 1/1 | 85 parts; |
| amino-modified silicone ("KF-393", manufactured and sold by Shinetsu) | 1 part; |
| epoxy-modified silicone ("X-22-343", manufactured and sold by Shinetsu) | 1 part. |

With use of the foregoing materials and compositions, the processings were carried out as in the foregoing Example D-4, to provide a final product card displaying portrait images as was desired.

Example D-6

Substrate

Same as in the foregoing Example D-4.

Weak-sticking adhesive layer

Same as in the foregoing Example D-4.

| Image-reception layer-forming composition | |
|---|---|
| polyester resin ("Vylon 600", manufactured and sold by Toyo Boseki) | 10 parts; |
| vinyl chloride-vinyl acetate copolymer resin ("Vinylite VAGH", manufactured and sold by Union Carbide Corp.) | 5 parts; |
| toluene/methyl ethyl ketone = 1/1 | 85 parts. |

The foregoing materials and compositions were prepared and processed in the similar way as in the foregoing Example D-4, to provide a final product card, displaying the desired portrait images as were desired.

Example E-1

On a polyethylene terephthalate film, 9 μm thick, a solution of saturated polyester resin, "Vylon 600", manufactured and sold by Toyo Boseki, in toluene/methyl ethyl ketone=1/1, was coated by reliance of the known reverse roll-coating process, and dried up. The coated quantity was 7 g/m$^2$ when measuring in dry condition. In this way, a weak-sticking adhesive layer could be formed.

On the weak-sticking adhesive layer, the following composition, 3 g/m$^2$ (dry), was coated by means of an oblique-lined gravure roll for solid and full printing use and in the reverse roll-coating process, and then dried up, to provide an image-reception layer.

| Image-reception layer-forming composition | |
|---|---|
| polyester resin ("Vylon 200", manufactured and sold by Toyo Boseki) | 70 parts; |
| polyester resin, ("Vylon 290", manufactured and sold by Toyo Boseki) | 30 parts; |
| amino-modified silicone ("KF-393", manufactured and sold by Shinetsu) | 5 parts; |
| epoxy-modified silicone ("X-22-343", manufactured and sold by Shinetsu) | 5 parts; |
| methyl ethyl ketone (wt. ratio 1/1) | 700 parts. |

On the opposite surface to the image-reception layer of the thus-prepared image-transferable sheet, a synthetic paper substrate, "Yupo FPG 110", 110 μm thick, manufactured and sold by Oji Yuka K.K., coated with "Vylon 600" as the adhesive agent in quantity of 10 g/m$^2$ (dry) was stuck intimately together.

On the other hand, a polyethylene terephthalate film substrate, 6 μm thick, preparatorily provided on one surface thereof with a heat-resisting layer was used and the following composition was applied on the opposite surface of the substrate with use of a wire bar and dried up, in the quantity of 1 g/m$^2$ (dry), so as to provide a dyestuff layer. In this way, a heat image-transferable sheet was prepared and provided.

| Dyestuff layer-forming composition | |
|---|---|
| dispersion dye ("Kayaseo Blue-136", manufactured and sold by Nippon Kayaku K. K.) | 4 parts; |
| ethylhydroxyethyl cellulose | 6 parts; |
| methylethylketone/toluene (wt. ratio: 1/1) | 90 parts. |

The dyestuff layer of the foregoing heat image-transfer sheet was brought into contact with the image-reception layer of the image-transferable sheet in overlapping manner, then, heat energy was applied from a thermal head from the side of heat-resisting layer of the heat image-transfer sheet, thereby dyestuff being transferred to the image-reception layer of image-transferable sheet, and indeed, for the formation of positive images.

Then, the image-transferable sheet, now carrying the required positive images was stuck together under heat and pressure at 140° C. for 5 seconds on the intermediate image-transfer substrate prepared in the following manner, in mutually opposed manner. Then, the synthetic paper "Yupo" was peeled off at the intersurface between the polyester resin film and the "Vylon 600" layer. In thus way, the inventive image-transfer sheet (intermediate image-transfer medium) carrying the corresponding reverse images was provided.

Method for the preparation of intermediate image-transfer substrate

A sheet of fine quality or stick paper, unit weight: 82 g/m$^2$ was applied with a coating, about 20 μm thick, of polyethylene resin through conventional extrusion coating process. Thereon, further, a catalyst-added toluene solution of a parting agent silicone, "KS-707", manufactured and sold by Shinetsu was applied and dried up in quantity of about 2 g/m$^2$ (dry), for the purpose of curing. Thereon, still further, the following coating liquid composition was applied by means of a conventional coating bar and dried up, to provide an intermediate image transfer substrate. The thus coated and dried resin quantity was measured to 7 g/m$^2$.

| Coating liquid composition | |
|---|---|
| polyester resin ("Vylon 200", manufactured and sold by Toyo Boseki) | 100 parts; |
| methyl ethyl ketone/toluene (mixing ratio by weight: 1/1) | 700 parts. |

A sheet of coated paper, pretreated for pore-filling, was coated, in the similar manner as above, with the foregoing liquid composition, to provide an image-transferable medium. On and with the presently coated surface, the image carrying surface of the foregoing intermediate image-transfer medium is brought into opposing contact and stuck together under heat and pressure at 140° C. for 7 seconds. Finally, the laminate of fine-quality paper and polyethylene was peeled off, to provide a final decorative product now displaying the positive images as required.

It will thus be seen that by adopting the above processing steps, the positive images formed under the action of the thermal head are transferred, through the intermediary of intermediate image transfer medium, onto the final object to be decorated, and indeed, in the form of positive mode. It will be further seen that, since the dyestuff is well distributed within the image-reception layer, the transferred positive images are highly sharp and fresh, in addition to much profundities.

Since a resin layer was overlappingly applied on the thus-formed images, weather fastness, frictional durability and light-fastness of the finally formed images could be highly and amazingly improved. When suitable ultraviolet absorbing agent, antioxydant, quenching agent and/or radical scavenger is added to, further improvement of the light-fastness can be attained.

Example E-2

The substrate of image-transferable medium adopted in the foregoing Example E-1 was replaced by a hard polyvinyl chloride card, 100 μm thick, and other processing modes were same as in Example E-1. In this way, a high quality, positive-image transferred, decorative final product was successfully provided. When the image include human portrait photograph, the final product was highly useful for ID-card.

Example E-3

The substrate of image-transferable medium adopted in the foregoing Example E-1 was replaced by a transparent polyester film, and other processing modes were same as employed therein. In this way, a transparent film formed with the wanted positive images of better quality as before was obtained. This film was highly useful in OHP-services.

Example E-4

A sheet of high quality paper, unit weight: 104 g/m$^2$, was coated with a layer of polypropylene resin, thickness: about 20 μm, through the way of conventional extrusion coating technique, then the coating was further coated with a silicone solution for use in parting service and hardenable under electron rays and dried up. The quantity of the coating silicone was about 1 g/m$^2$ upon drying. In this way, an electron-hardened, provisional substrate was provided. On this substrate, the following, image-reception layer-forming composition was applied as a layer by use of a coating bar, and then dried up, for providing an image-reception layer. The coated resin quantity in the above last step amounted about 5 g/m$^2$.

| Image-reception layer-forming composition | |
|---|---|
| polystyrene ("Picolastic D 150" (Tg = 69° C.), manufactured and sold by Rika-Hercules Co., Ltd. | 100 parts; |
| amino-modified silicone ("KF-393", manufactured and sold by Shinetsu) | 7 parts; |
| epoxy-modified silicone ("X-22-343", manufactured and sold by Shinetsu) | 7 parts. |

Further processing was carried out as was set forth in the foregoing Example E-2, for providing a final product card, carrying thereon the wanted positive images of same superior quality, as was in Example E-2.

Example E-5

On the image transferable medium used in the foregoing Example E-4, however, in the present Example, a thermoplastic resin, adhesive, polyolefine-series film, "Adwin 500", manufactured and sold by Showa Denko K.K., Tokyo, was applied as a layer. Other materials were used and processed as set forth therein. In this way, a decorative final product formed with necessary positive was obtained with superior results.

Industrial Availabilities

As will be well understood from the foregoing detailed description of the invention, it is possible according to the present inventive system, to form highly easily and evenly the desired images sharply and attractingly on any product and object to be decorated or graphically ornamented, substantially irrespective of material kind and configuration thereof, and indeed, with a surprising unitary touch and feeling with the substrate. Therefore, the invention can be utilized broadly and conveniently in such various industrial fields, where unitary formation of various images, characters, symbols, numerals and graphics, on and to the articles, objects and substrate products to a sufficiently miracle and attracting degree.

We claim:

1. A sublimatingly image transferred product comprising:

a plastic card; and an image-reception layer containing a releasing agent provided on said plastic card, said image-reception layer being directly formed on said plastic card by thermal fusion, and said image-reception layer having a transferred image formed by sublimation transfer, said transferred image being formed on the plastic card surface side.

2. The sublimatingly image transferred product of claim 1, further comprising a protective layer formed on said image-reception layer.

3. The sublimatingly image transferred product of claim 2, wherein said protective layer contains an ultraviolet absorbing agent and/or a photostabilizer.

4. The sublimatingly image transferred product of claim 2, wherein said protective layer comprises a resin selected from the group consisting of an alkyd resin, a phenol-modified alkyd resin, an aminoalkyd resin, a phenol resin, a urea resin, a melamine resin, a silicone resin, a thermosetting resin, a cold setting resin, an actinic lay hardenable resin, and a thermoplastic resin.

5. The sublimatingly image transferred product of claim 4, wherein said thermoplastic resin comprises a resin selected from the group consisting of a polyester resin, a polyurethane resin, a polyvinyl acetate resin, a vinyl chloride-vinyl acetate copolymer, a polyolefin resin, and an acrylic resin.

6. The sublimatingly image transferred product of claim 1, wherein said image-reception layer comprises a resin selected from the group consisting of a polyester resin, a polyacrylic ester resin, a polycarbonate resin, a polyvinyl acetate resin, a styrene-acrylate resin, a vinyltoluene-acrylate resin, a polyurethane resin, a polyamide resin, a polycaprolactone resin, a polystyrene resin, a polyvinylchloride resin, and a polyacrylonitrile resin.

* * * * *